US005967115A

United States Patent [19]

Konopka et al.

[11] Patent Number: 5,967,115

[45] Date of Patent: Oct. 19, 1999

[54] ELECTRONIC CONTROLS FOR COMPRESSION RELEASE ENGINE BRAKES

[75] Inventors: John Konopka, Feeding Hills, Mass.; Haoran Hu, Novi, Mich.; Real Mercier, West Springfield, Mass.

[73] Assignee: Diesel Engine Retarders, Inc., Wilmington, Del.

[21] Appl. No.: 09/022,026

[22] Filed: Feb. 11, 1998

Related U.S. Application Data

[63] Continuation-in-part of application No. 08/320,049, Oct. 7, 1994, Pat. No. 5,718,199.

[51] Int. Cl.[6] ..... F02D 13/04

[52] U.S. Cl. ..... 123/322; 123/323; 123/568.14

[58] Field of Search ..... 123/90.11, 321, 123/322, 323, 90.15, 568.14

[56] References Cited

U.S. PATENT DOCUMENTS

| | | | |
|---|---|---|---|
| 4,009,695 | 3/1977 | Ule | 123/90.13 |
| 4,355,605 | 10/1982 | Robinson et al. | 123/320 |
| 4,398,510 | 8/1983 | Custer | 123/90.16 |
| 4,572,114 | 2/1986 | Sickler | 123/21 |
| 4,592,319 | 6/1986 | Meistrick | 123/321 |
| 4,664,070 | 5/1987 | Meistrick et al. | 123/21 |
| 4,945,870 | 8/1990 | Richeson | 123/90.11 |
| 5,012,778 | 5/1991 | Pitzi | 123/321 |
| 5,121,723 | 6/1992 | Stepper et al. | 123/322 |
| 5,146,890 | 9/1992 | Gobert et al. | 123/321 |
| 5,168,855 | 12/1992 | Stone | 123/446 |
| 5,191,867 | 3/1993 | Glassey | 123/446 |
| 5,479,890 | 1/1996 | Hu et al. | 123/322 |
| 5,483,927 | 1/1996 | Letang et al. | 123/41.12 |
| 5,540,201 | 7/1996 | Feucht et al. | 123/322 |
| 5,718,199 | 2/1998 | Hu et al | 123/322 |

FOREIGN PATENT DOCUMENTS

| | | |
|---|---|---|
| 42 36 009 | 4/1994 | Germany . |
| 1395027 | 5/1975 | United Kingdom . |

*Primary Examiner*—Tony M. Argenbright
*Attorney, Agent, or Firm*—Collier, Shannon, Rill & Scott, PLLC

[57] ABSTRACT

Electronic controls for compression release engine retarders of internal combustion engines which provide electronic signals to control hydraulic valves assembled in the hydraulic actuators of the retarders, to open engine exhaust valves to provide compression release events. The electronic controls may produce signals for both opening and/or closing the controlled valves. The electronic controls may monitor various engine operating conditions and/or parameters with one or more sensors distributed in the engine and vehicle in which the engine is installed. The timing of valve actuation, particularly that for compression release events, can be automatically modified responsive to the level of engine operating conditions and parameters. Various operating routines for the electronic controls are also disclosed.

22 Claims, 31 Drawing Sheets

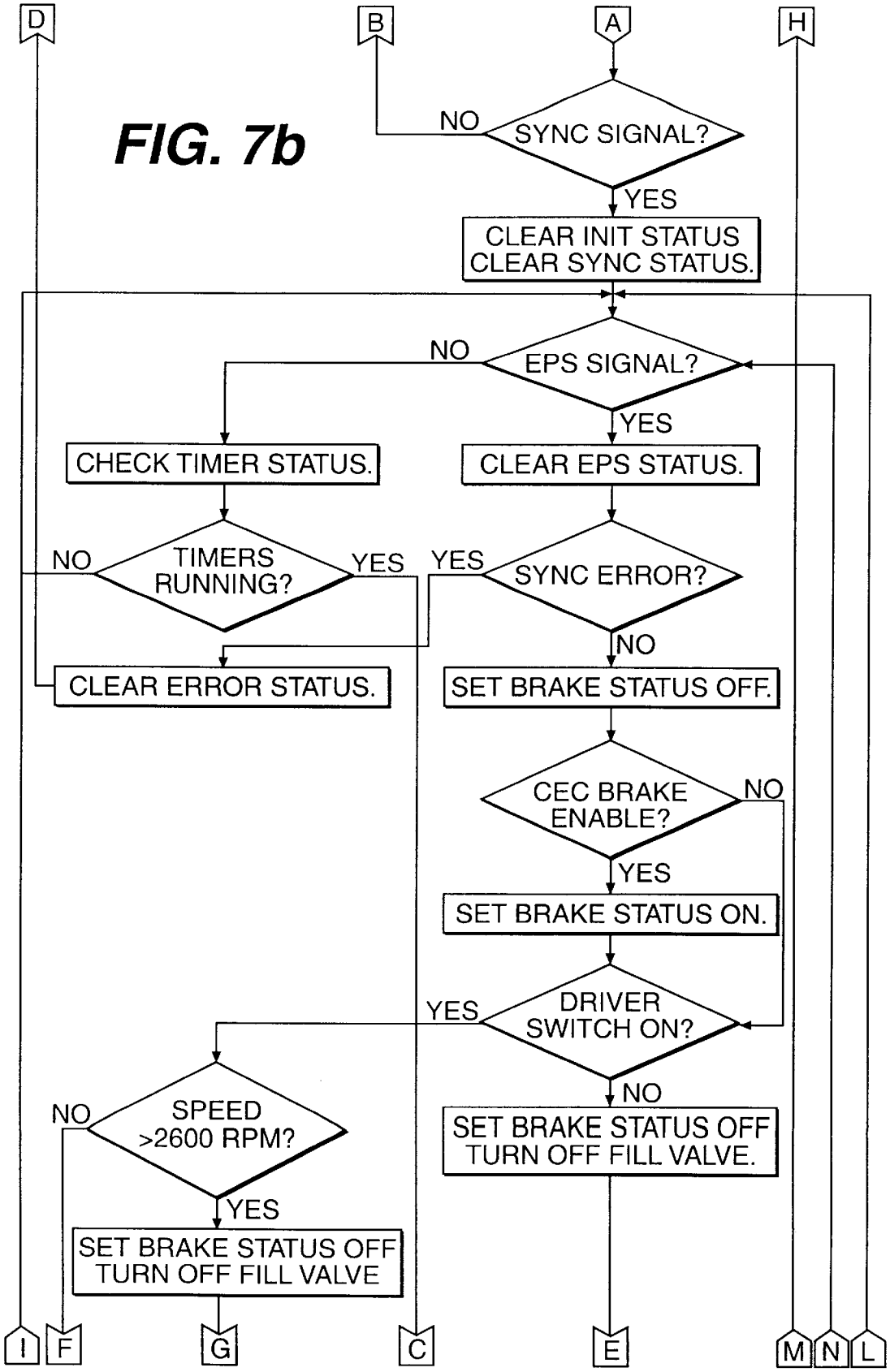
FIG. 7b
D
B
A
H
SYNC SIGNAL?
NO
YES
CLEAR INIT STATUS
CLEAR SYNC STATUS.
EPS SIGNAL?
NO
YES
CHECK TIMER STATUS.
CLEAR EPS STATUS.
TIMERS RUNNING?
NO
YES
SYNC ERROR?
YES
NO
CLEAR ERROR STATUS.
SET BRAKE STATUS OFF.
CEC BRAKE ENABLE?
NO
YES
SET BRAKE STATUS ON.
DRIVER SWITCH ON?
YES
NO
SPEED >2600 RPM?
NO
YES
SET BRAKE STATUS OFF TURN OFF FILL VALVE.
SET BRAKE STATUS OFF TURN OFF FILL VALVE
I
F
G
C
E
M
N
L

ELECTRONIC CONTROLS FOR COMPRESSION RELEASE ENGINE BRAKES

CROSS REFERENCE TO RELATED PATENT APPLICATIONS

This application is a Continuation-in-Part of prior U.S. patent application Ser. No. 08/320,049 filed Oct. 7, 1994, now U.S. Pat. No. 5,718,199.

BACKGROUND OF THE INVENTION

This invention relates to compression release engine brakes, and more particularly to electronic controls for such engine brakes.

As is well known to those skilled in the art, compression release engine brakes operate to temporarily convert an associated internal combustion engine from a power source to a power-absorbing gas compressor when the engine brake is turned on and the fuel supply to the engine is cut off. In general, such engine brakes operate in this way by opening the exhaust valve in the engine cylinders when the engine cylinders contain air they have compressed. For example, the engine brake may open an exhaust valve in the engine near top dead center of each compression stroke of the engine cylinder served by that exhaust valve. This allows compressed air to escape from the engine, thereby preventing the engine from recovering the work of compressing that air. (As an alternative to using a conventional exhaust valve for this purpose, the same result may be achieved by having the engine brake open a special-purpose valve that has been added to each engine cylinder. (See, for example, Gobert et al. U.S. Pat. No. 5,146,890.) Because such special-purpose valves are so much like conventional exhaust valves in this connection, it will be understood that, as used herein, terms like "exhaust valves" include both conventional exhaust valves and special-purpose valves added for use in producing compression release events. By preventing the engine from recovering the work of compressing air the engine has compressed, the engine brake enables the engine to absorb much more kinetic energy from the vehicle powered by the engine. The engine therefore becomes much more effective in slowing down or holding back the vehicle, thereby prolonging the life of the vehicle's wheel brakes and increasing vehicle safety.

Most known compression release engine brakes produce the above-described exhaust valve openings by hydraulically transferring an appropriately timed motion from another part of the engine to the exhaust valve to be opened to produce a compression release event. For example, a master piston in a hydraulic circuit in the engine brakes may be operated by an intake or exhaust valve opening mechanism of another engine cylinder or by the fuel injector mechanisms of the same engine cylinder in which the compression release event is to be produced. A slave piston in that hydraulic circuit responds to operation of the master piston by opening an associated exhaust valve to produce the compression release event.

It can be difficult or even impossible to produce optimally timed exhaust valve openings at all operating speeds, using the conventional approach described above. Many complex mechanical, hydraulic, etc., refinements have been devised to improve the compression release event timing options available to the engine brake designer. Some of these refinements work extremely well, but they have a tendency to increase the cost of the engine brake.

Recently, engine brakes have been developed which use electronically controlled valves to apply high pressure hydraulic fluid to hydraulic actuators which open associated engine exhaust valves to produce compression release events. Examples of such engine brakes are shown in Pitzi, U.S. Pat. No. 5,012,778 (Jul. 7, 1991) and Hu et al., U.S. Pat. No. 5,429,890 (Jan. 2, 1996) for Externally Driven Compression Release Retarders. More sophisticated electronic controls are needed for such brakes.

In view of the foregoing, it is an object of this invention to provide improved electronic controls for compression release engine brakes.

It is another object of this invention to provide improved electronic controls for compression release engine brakes of the type which employ electronically controlled valves for applying high pressure hydraulic fluid to hydraulic actuators when compression release events are desired.

It is a further object of the invention to provide methods of controlling electronically controlled hydraulic actuators.

SUMMARY OF THE INVENTION

These and other objects of the invention are accomplished in accordance with the principles of the invention by providing electronic engine brake controls which monitor various conditions in the associated engine and vehicle to determine appropriate timing for compression release events during operation of engine brake. For example, the electronic controls may monitor such engine and vehicle operating parameters as a request for engine braking from the driver of the vehicle, cut off of fuel supply to the engine, engine drive train clutch engagement, transmission in an appropriate gear, engine speed, vehicle speed, engine camshaft or crankshaft position, engine cylinder pressure, turbocharger boost pressure, a request from the driver for a particular engine speed or vehicle speed, ambient air temperature, ambient barometric pressure, cylinder temperature, exhaust back pressure, hydraulic actuator fluid pressure, etc. On the basis of these parameters the electronic controls produce output signals for controlling hydraulic valves (e.g. trigger valves) in the engine brake. The hydraulic valves may selectively apply high pressure hydraulic fluid to hydraulic actuators in the engine brake for the purpose of opening engine exhaust valves to produce compression release events. For example, the electronic controls may open and close the above-mentioned hydraulic valves at times corresponding to predetermined constant engine camshaft or crankshaft position based on current values of other engine operating parameters such as engine speed. The electronic controls may determine the appropriate compression release event timings by looking them up in a look-up table stored in a memory of the controls, or the electronic controls may perform a predetermined calculation to compute the appropriate timings.

In a particular embodiment, the hydraulic valves in the engine brake may be replaced with electromagnetic valves, and the electronic controls produce appropriately timed signals for each electromagnetic valve.

Further features of the invention, its nature and various advantages will be more apparent from the accompanying drawings and the following detailed description of the preferred embodiments.

BRIEF DESCRIPTION OF THE DRAWINGS

FIGS. 7*a*, 7*b*, 7*c*, and 7*d* (collectively referred to as FIG. 7) is a flow chart illustrative of an engine brake operating sequence of the invention.

DETAILED DESCRIPTION OF THE PREFERRED EMBODIMENTS

Figure 1:
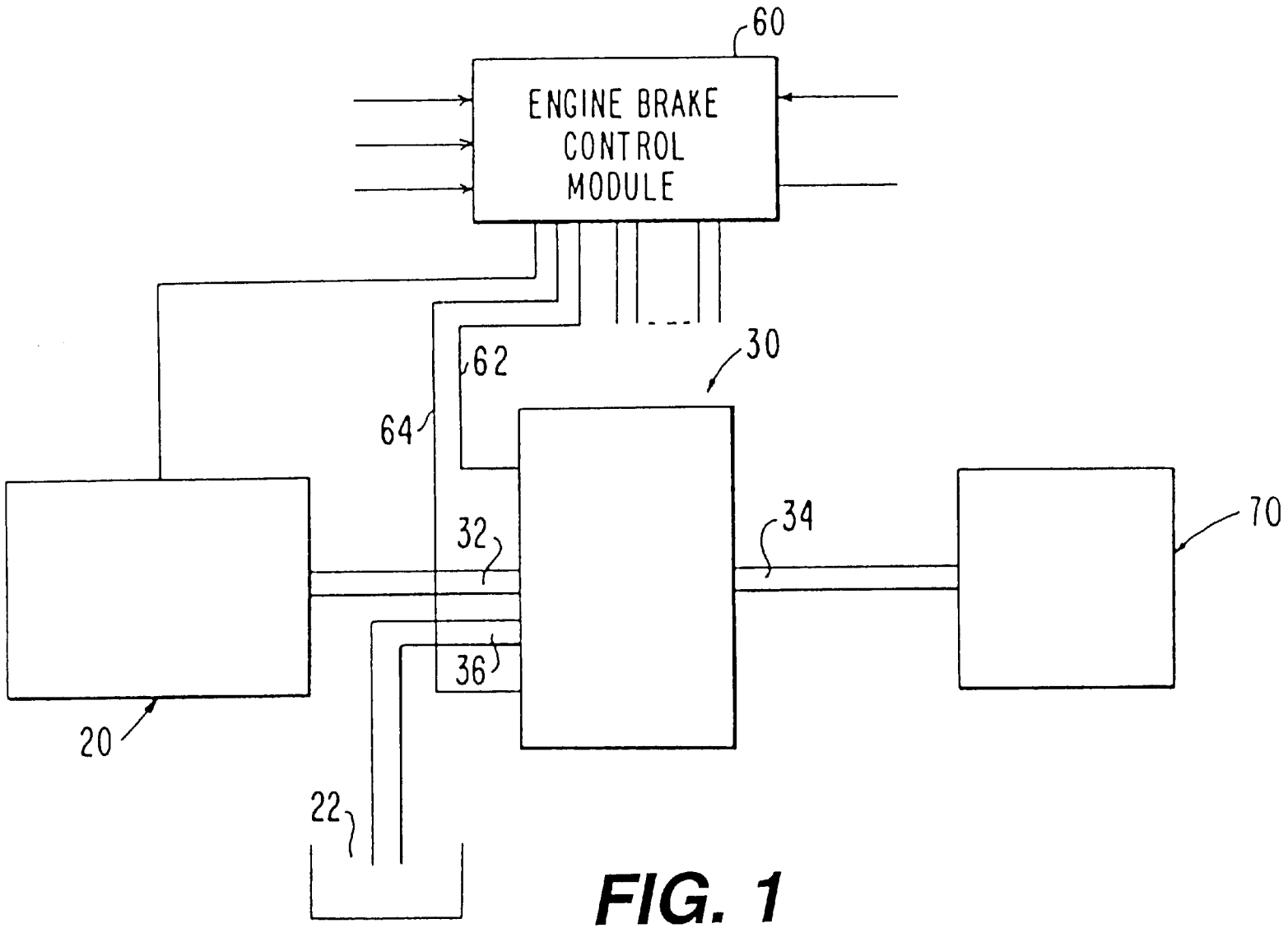
FIG. 1 is a simplified, partial, block diagram depiction of illustrative compression release engine brake apparatus which can be controlled by the electronic controls of this invention.
Figure 12:
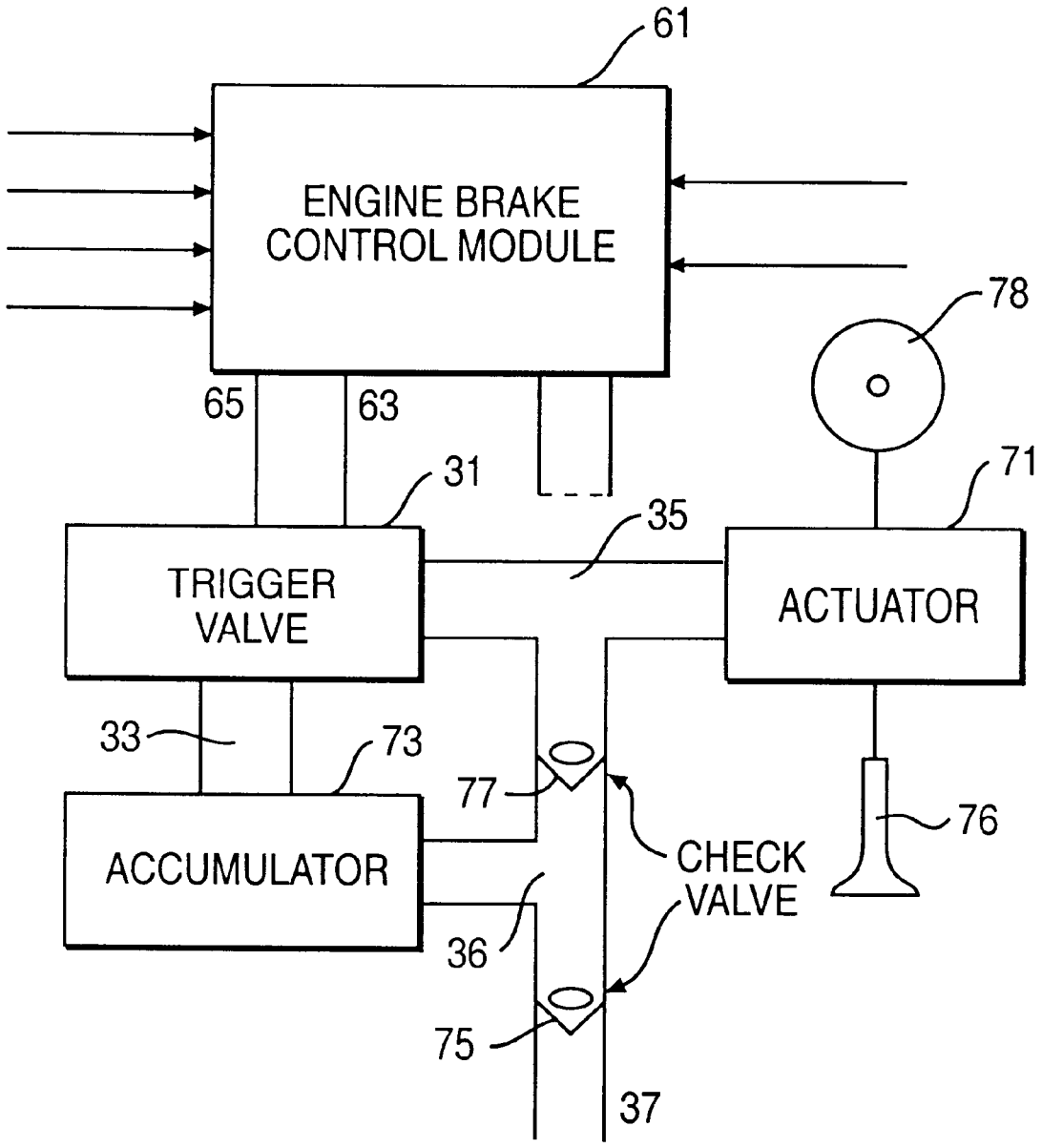
FIG. 12 is a schematic diagram of an alternative engine brake apparatus to that shown in FIG. 1.

Illustrative compression release engine brake apparatus (i.e. means for selectively actuating a valve) with which the electronic controls of this invention can be used are shown in FIGS. 1 and 12.

With reference to FIG. 1, element 20 is a source of high pressure hydraulic fluid. The hydraulic fluid may be engine lubricating oil, or fuel, and source 20 may be a pump powered by the internal combustion engine associated with the engine brake. Valve 30 is an electrically (preferably electromagnetically) operated hydraulic valve. When valve 30 is in the "open" position, port 32 is connected to port 34. High pressure hydraulic fluid from source 20 may be applied to element 70, which is a hydraulic device for producing a compression release event in the associated internal combustion engine (e.g., by opening an exhaust valve in the engine near top dead center of the compression stroke of the engine cylinder served by that exhaust valve. On the other hand, when valve 30 is in its "closed" position, port 32 is closed off and port 34 is connected to port 36. This allows hydraulic fluid to flow out of element 70 to low pressure hydraulic fluid sink 22 and the engine may return to its non-retarding condition.

Valve 30, which may be implemented with a high speed trigger valve, is energized at the appropriate times by electrical signals from engine brake control module 60, which may be an electronic control in accordance with this invention. As will be discussed in more detail below, control module 60 may receive various inputs from the engine and the associated vehicle. Control module 60 may do the same with respect to other hydraulic valves in the engine brake, which other hydraulic valves may open other exhaust valves in the engine to produce compression release events in the engine cylinders served by those other exhaust valves.

FIG. 1 shows an embodiment in which control module 60 applies one signal via lead 62 to open valve 30 and another signal via lead 64 to close valve 30. Examples of hydraulic valves which operate in this way are shown in commonly assigned application Ser. No. 08/320,178, now U.S. Pat. No. 5,479,890, which is hereby incorporated by reference herein. Alternatively, valve 30 can be of a type requiring only the presence or absence of a single signal to respectively open and close the valve. An example of a hydraulic valve which operates in this way is shown in the above-mentioned Pitzi U.S. Pat. No. 5,012,778, which is also hereby incorporated by reference herein. Other examples of valves of this type are shown in commonly assigned application Ser. No. 08/320,178, now U.S. Pat. No. 5,537,975, which is also incorporated by reference herein.

An alternative engine brake apparatus is shown in FIG. 12. The engine brake apparatus includes a port 37 that may supply low pressure oil to a low pressure circuit 36 in the system through check valve 75. When the pressure above the check valve 75 equals or exceeds the pressure below the check valve 75, then the check valve may close. Low pressure oil may also be provided to the remainder of the system (e.g. high pressure circuit 15) through a second check valve 77. The second check valve 77 may be a one-way valve that prevents oil from flowing back past the second check valve 77 towards the other check valve 75.

High pressure circuit 35 may initially fill with low pressure oil and provide oil communication between an actuator 71 and a trigger valve 31. Trigger valve 31 may be selectively opened and closed responsive to control signals received from an engine brake control module 61 through connections 63 and 65. When the trigger valve 31 is closed, the oil provided to the actuator 71 is trapped in the actuator because it cannot flow past the trigger valve 31 or the second check valve 77. Trapping oil in the actuator 71 may result in the actuator transferring any motion imparted to it from the valve train 78 (e.g. cam) to an engine valve 76. Thus, when the trigger valve 31 is closed, the valve 76 may be displaced according to the profile of the cam 78.

In order to selectively lose the motion attributable to the cam 78 profile, the trigger valve 31 may be selectively opened. When the trigger valve 31 is open, the cam 78 profile pushes oil out of the actuator 71 and through the trigger valve rather than displacing the engine valve 76. Because the trigger valve 31 is open, the oil pushed out of the actuator 71 may pass through the trigger valve to the accumulator 73, where the oil may be temporarily stored. Oil stored in the accumulator 73 may then be returned to the low pressure circuit 36. By opening and closing the trigger valve 31 at appropriate times during the engine operation, many combinations of motion transfers can occur between the cam 78 and the engine valve 76.

Figure 2:
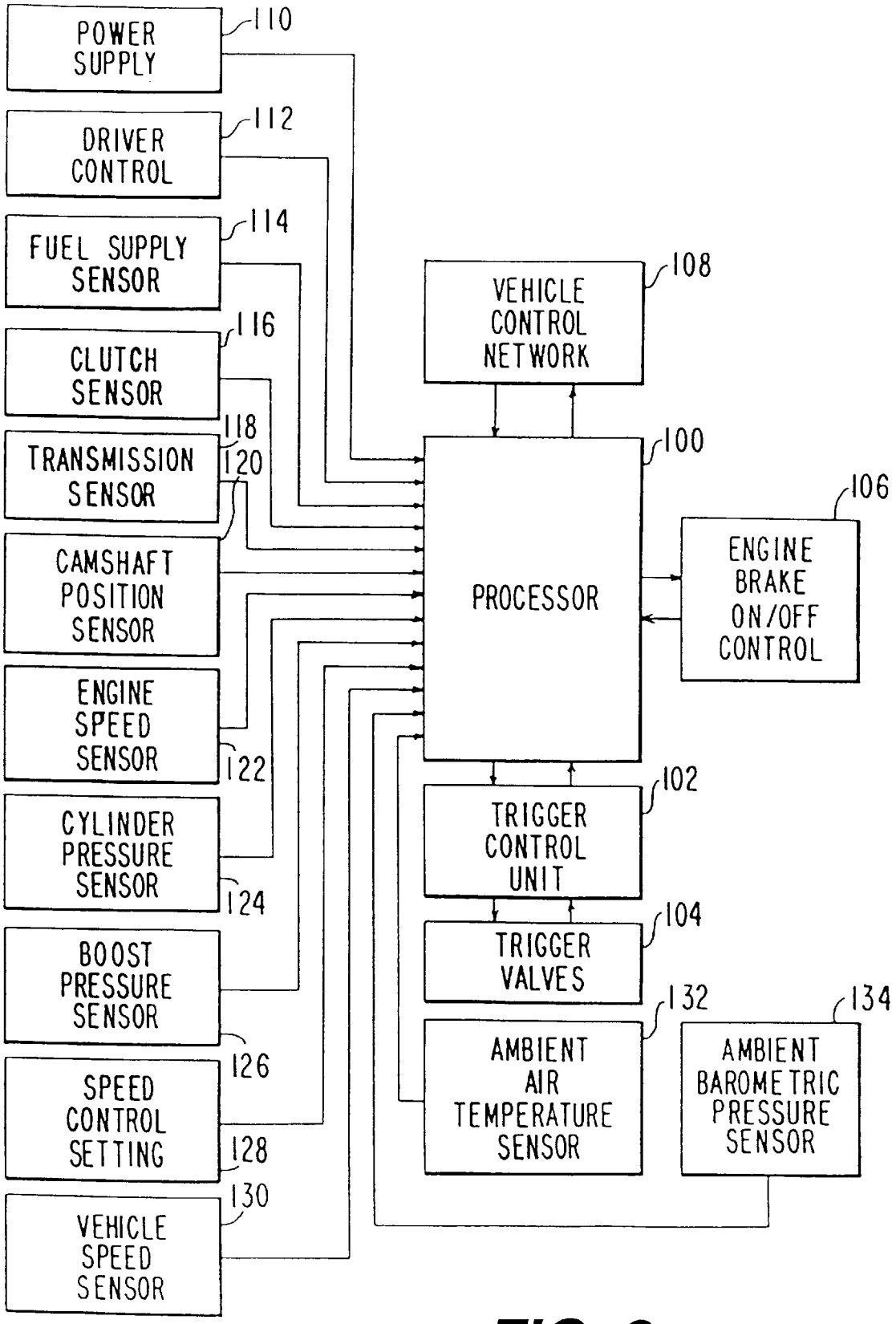
FIG. 2 is a block diagram of illustrative electronic controls constructed in accordance with this invention.
Figure 5:
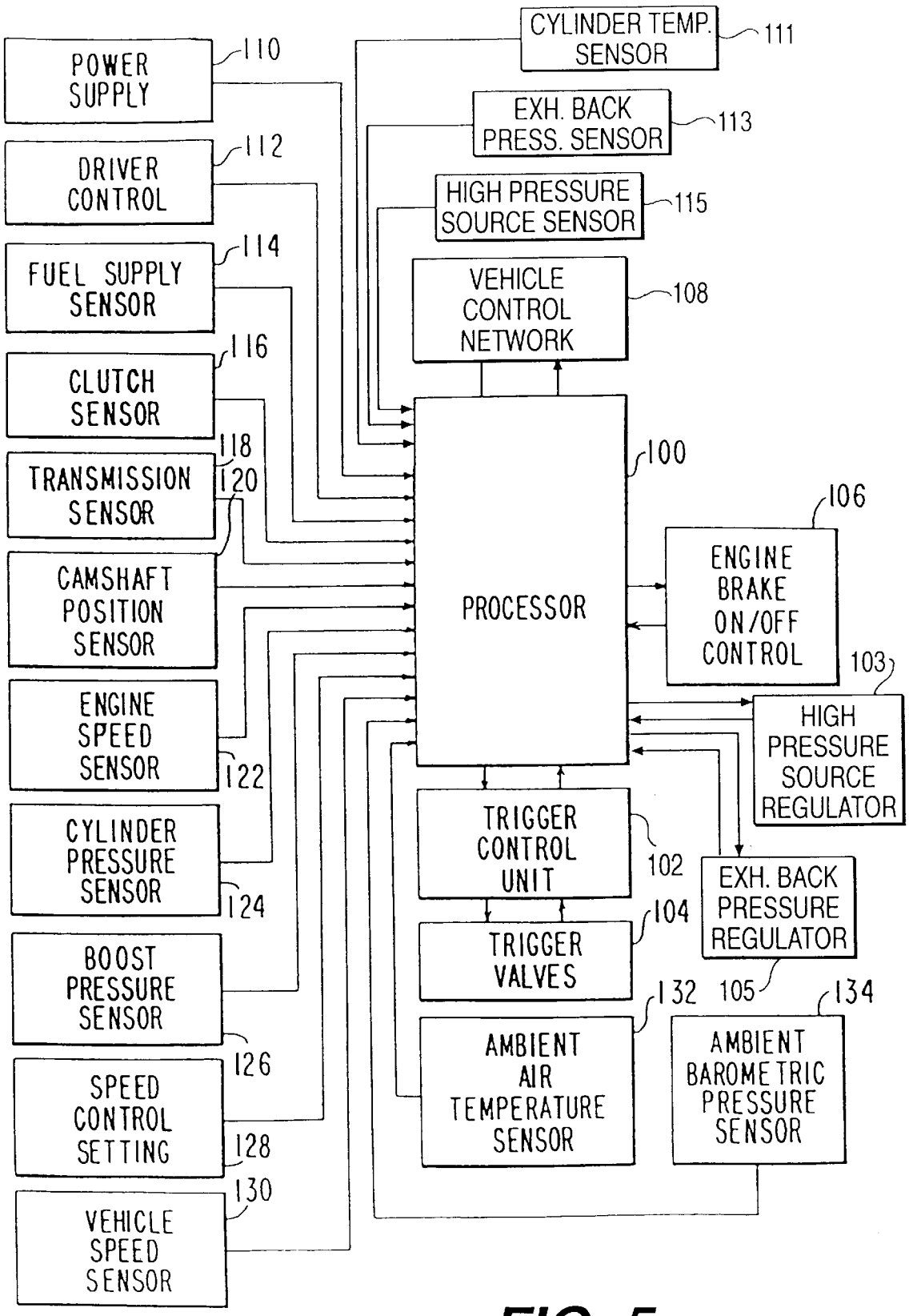
FIG. 5 is a block diagram of illustrative electronic controls constructed in accordance with an alternative embodiment of the invention.

Illustrative engine brake control apparatus in accordance with this invention are shown in more detail in FIGS. 2 and 5. In FIGS. 2 and 5, elements 100 and 102 correspond collectively to element 60 in FIG. 1 and element 61 in FIG. 12. Processor 100 may be an appropriately programmed general-purpose microprocessor augmented by appropriate memory for program and data storage, or it may be specially adapted logic circuitry. Trigger control unit 102 provides an interface between the typically digital logic of processor 100 and the typically analog electrical power requirements of the electrically controlled hydraulic valves 104 in the engine brake (of which valve 30 in FIG. 1 may be typical). With regard to FIGS. 1 and 5, a high pressure source sensor 115 may monitor the pressure of high pressure source 20 at the port 32. A regulator valve 103 may regulate the pressure at port 32, responsive to a signal received from the processor 100, which generates such signal in response to a signal received from the high pressure source sensor 115.

With renewed reference to both FIGS. 2 and 5, element 106 may be a solenoid or other similar device for turning high pressure hydraulic fluid source 20 in FIG. 1, on and off (assuming that source 20 requires such on/off control and is not on whenever the engine is operating). Element 108 may be the conventional control network of the vehicle associated with the engine and engine brake. For example, network 108 may include a conventional engine control module, a conventional transmission control module, a conventional wheel brake control module (including anti-lock braking control), etc. As a safety precaution, vehicle control network 108 may be capable of automatically calling for engine braking under certain engine or vehicle operating conditions detected by that network, even though the drive of the vehicle has not called for engine braking. Similarly, network 108 may be capable of overriding a driver request for engine braking and turning off the engine brake if engine or vehicle operating conditions warrant such action.

Processor 100 receives inputs from any or all of the elements shown along the left-hand side and across the bottom of FIGS. 2 and 5. Some or all of these elements may not feed processor 100 directly, but may instead supply their inputs to processor 100 via the vehicle control network 108. Direct connection of these elements to processor 100 is shown in FIGS. 2 and 5 for greater clarity and simplicity. Power supply 110 supplies the power required to operate processor 100. For example, power supply 110 may be the conventional DC power supply of the vehicle (e.g., 12V, 24V, or 110V). Driver control 112 may be a conventional switch in the cab of the vehicle for allowing the driver of the vehicle to select or deselect compression release engine braking. Fuel supply sensor 114 may be a conventional element for sensing when the fuel supply to the engine has been cut off. Clutch sensor 116 may be a conventional element for sensing when the vehicle clutch is engaged. Transmission sensor 118 may be a conventional element for indicating the gear that the transmission is in. Camshaft position sensor 120 may be a conventional element for indicating the angular position of the camshaft in the engine. As an alternative to, or in addition to, a camshaft sensor which has a 720° range in a four-cycle engine, it may be possible in some cases to use an engine crankshaft position sensor having a 360° range. For example use of a crankshaft position sensor may be suitable in applications in which the engine converts from four-cycle power mode operation to two-cycle air compressor operation as in Hu U.S. Pat. No. 5,537,976.

Engine speed sensor 122 may be a conventional tachometer-type device for indicating the speed of the engine. Cylinder pressure sensor 124 (and cylinder temperature sensor 111 in the FIG. 5 embodiment) may be conventional engine instrumentation for indicating the gas pressure (and temperature) in the engine cylinders. These sensors can provide another indication of engine speed and performance. Boost pressure sensor 126 (and exhaust back pressure sensor 113 in the FIG. 5 embodiment) may be other conventional engine instrumentation for indicating gas pressure in the intake manifold and the exhaust manifold, respectively, of the engine (assuming that the engine is equipped with a turbocharger). These sensors can also provide the processor 100 with indications of engine speed and performance.

With regard to FIG. 5 alone, an exhaust back pressure regulator 105 may regulate exhaust back pressure in response to a control signal received from the processor 100. Exhaust back pressure may be regulated by varying the exhaust brake discharging orifice; or other means of controlling exhaust manifold pressure.

With continued reference to FIGS. 2 and 5, speed control setting 128 may be another driver control for allowing the driver to set a desired engine or vehicle speed during engine braking (analogous to so-called "cruise control" during power mode operation). Vehicle speed sensor 130 may be another conventional tachometer-type device for indicating the speed of the vehicle. Ambient air temperature sensor 132 may be a thermometer-type device for indicating the temperature of the ambient air as a measure of changes in the mass of air the engine is receiving. Ambient barometric pressure sensor 134 may be a barometer-type device for indicating ambient barometric pressure as another measure of the mass of air the engine is receiving. These "ambient" temperature and barometric pressure measurements may be taken at any convenient and suitable locations such as outside the engine or anywhere along the engine air intake structure.

Figure 3A:
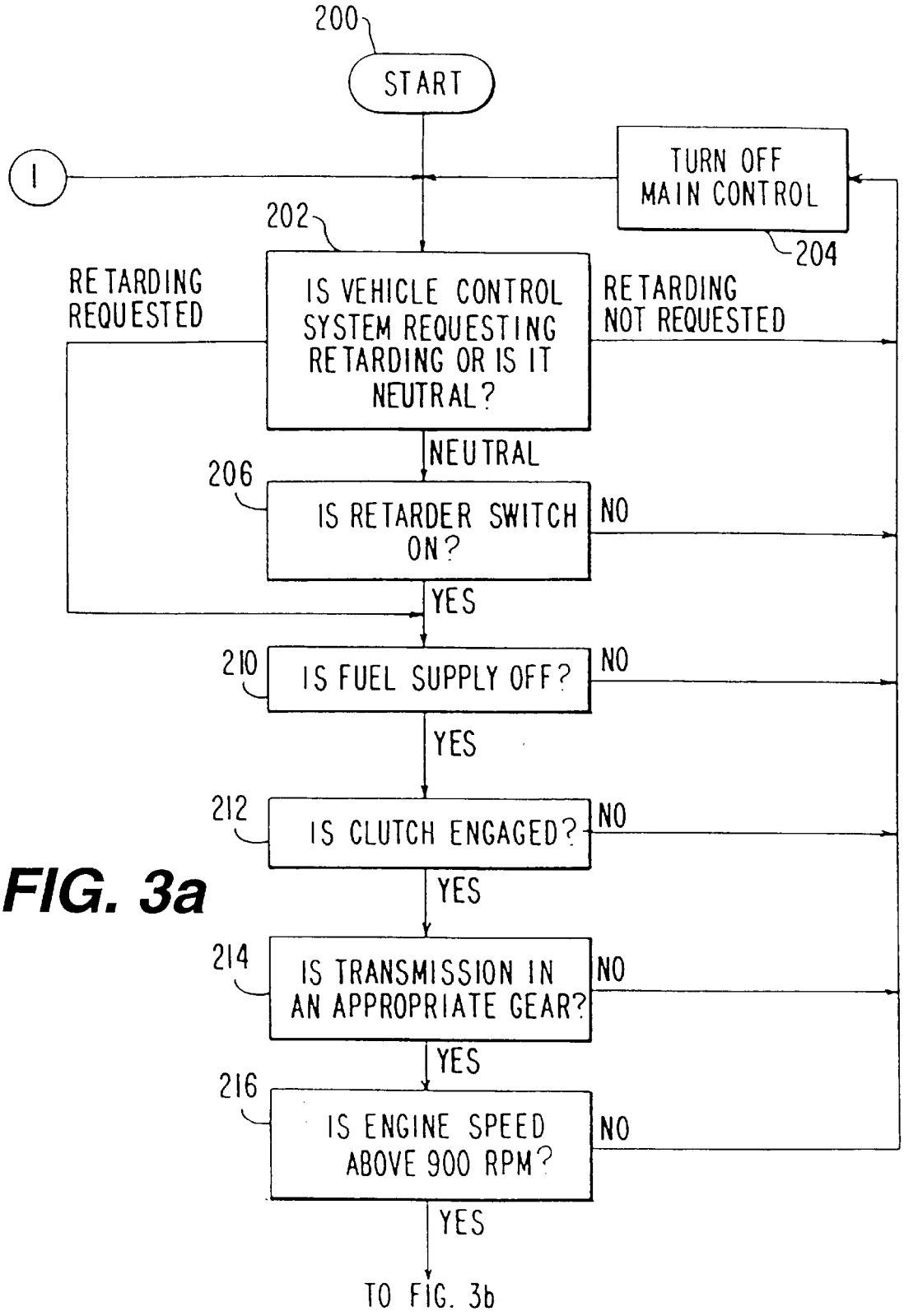
FIGS. 3*a*, 3*b* and 3*c* (collectively referred to as FIG. 3) is a flow chart of an illustrative operating sequence that can be performed by a portion of the apparatus shown in FIG. 2 in accordance with this invention.
Figure 3B:
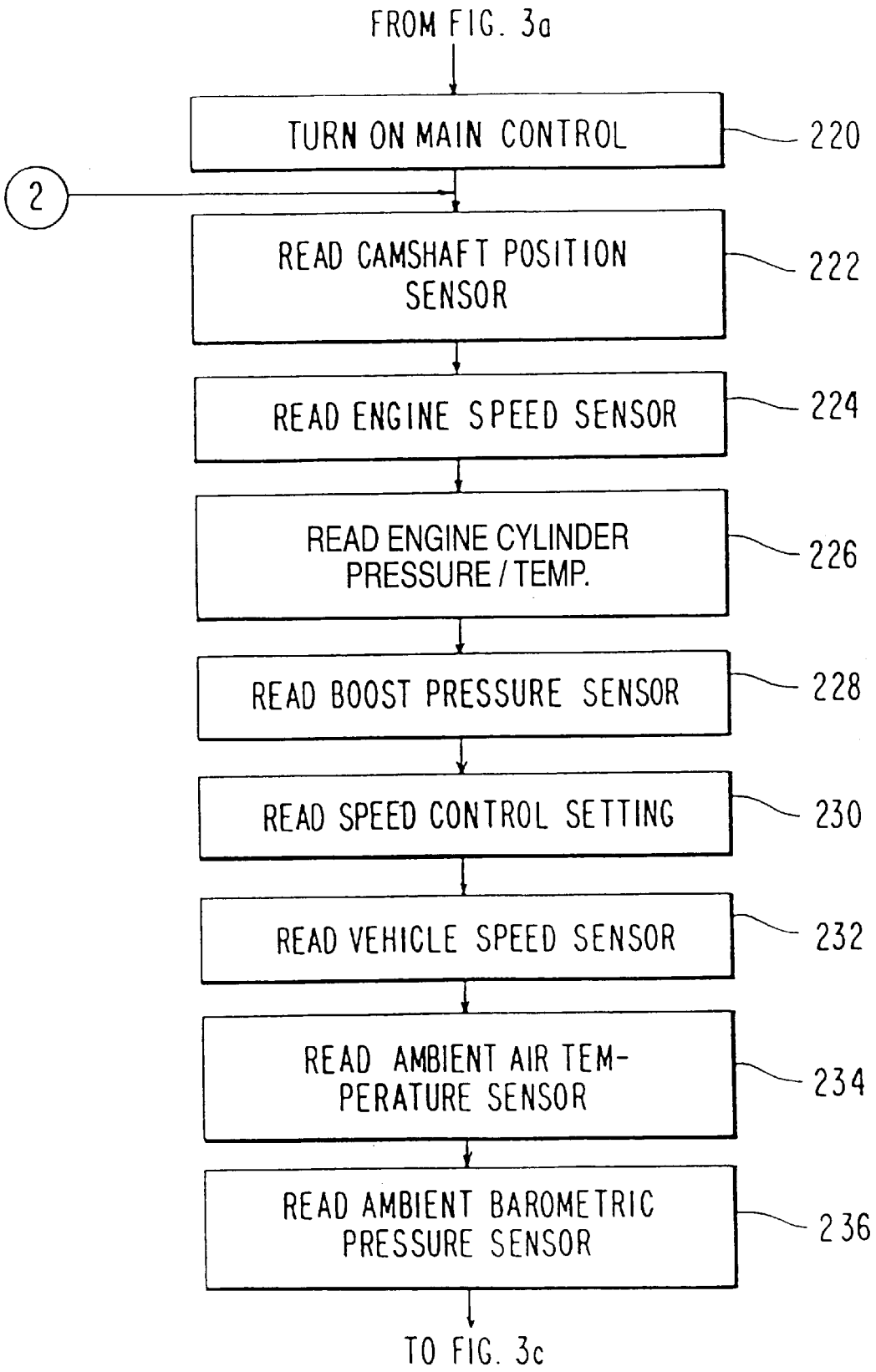

An illustrative operating sequence for processor 100 is shown in FIG. 3. This sequence starts at 200 and proceeds first to step 202 where processor 100 determines whether vehicle control network 108 is calling for retarding (i.e. compression release engine braking), or if network 108 is calling for retarding to cease or to be prevented, or if network 108 is neutral as to whether retarding should be allowed. If network 108 is calling for retarding to cease or to be prevented, control passes to step 204, whereby processor 100 turns off main engine brake control 106. If network 108 is neutral with regard to engine braking, control passes to step 206 where processor 100 checks the state of driver control 112. If the driver has not requested engine braking, control passes from step 206 to step 204. On the other hand, if the driver has requested engine braking, control passes from step 206 to step 210. If in step 202 processor 100 finds that network 108 is requesting retarding, control passes directly from step 202 to step 210.

Step 210 is the first of several steps performed by processor 100 to make sure that the operating conditions of the engine and vehicle are appropriate for the commencement or continuation of engine brake operation. In step 210 processor 100 checks fuel supply sensor 114 to make sure that the fuel supply to the engine has been cut off. If the fuel has not been cut off, control passes from step 210 to step 204. On the other hand, if the fuel supply is off, control passes from step 210 to step 212. In step 212 processor 100 checks sensor 116 to make sure that the vehicle's clutch is engaged. If not, control passes from step 212 to step 204 But if the clutch is engaged, control passes from step 212 to step 214. In step 214 processor 100 checks sensor 118 to make sure that the vehicle transmission is in an appropriate gear for engine brake operation. For example, if the transmission is in a neutral condition, engine brake operation should probably not be permitted, just as it is not permitted when the clutch is not engaged. If the transmission is not in an appropriate gear for engine brake operation, control passes from step 214 to step 204. But if the transmission is in an appropriate gear, control passes from step 214 to step 216. In step 216 processor 100 checks engine speed sensor 122 to make sure that the engine speed is at least at a minimum that is appropriate for engine brake operation. For example, step 216 may require the speed at the engine to be at least 900 RPM. If the engine is not operating at least at that speed, control passes from step 216 to step 204. But if the speed of the engine is above the threshold required for engine brake operation, control passes from step 216 to step 220.

When step 220 is reached, processor 100 has found that all the conditions necessary for operation of the engine brake are present (or continue to be present). Accordingly, in step 220 processor 100 turns on main engine brake control 106. Processor 100 then performs a series of steps appropriate to enable it to determine when each of the trigger valves in the engine brake should be opened (to produce compression release events in the engine) and close (to ready the associated engine cylinder to produce its next compression release event).

In step 222 processor 100 reads camshaft position sensor 120. (In the above-mentioned alternative, useful for two cycle engine braking, in which a crankshaft position sensor rather than a camshaft position sensor is used, step 222 would involve reading, the crankshaft position sensor). This step is the primary source of synchronism between the operation of the engine and the timing of the compression release events controlled by processor 100. Processor 100 may read camshaft position sensor 120 on an effectively continuous basis, or it may read sensor 120 somewhat less frequently and use an approximately concurrent reading of engine speed sensor 122 (step 224) to provide a basis for calculating camshaft position between actual readings of sensor 120.

In steps 224, 226, 228, 230, 232, 234, and 236, processor 100 may read any of several sensors whose output values may make it appropriate for processor 100 to modify the timings of the compression release events it produces or to otherwise modify the operation of the engine brake. For example, in step 224 processor 100 may read engine speed sensor 122. In step 226 processor 100 may read engine cylinder pressure sensor 124 and cylinder temperature sensor 111. In step 228 processor 100 may read turbocharger boost pressure sensor 126. In step 230 processor 100 may read a desired speed setting established by the driver via control 128. In step 232 processor 100 may read vehicle speed sensor 130. In step 234 processor 100 may read ambient air temperature sensor 132. And in step 236 processor 100 may read ambient barometric pressure sensor 134.

In step 240 processor 100 may use data from the preceding steps to determine the engine braking torque currently required from the engine. For example, if the current engine braking torque is TC, and if the current engine or vehicle speed is less than the desired speed indicated by control 128, processor 100 may determine that the new engine braking torque requirement TN should be TC−DT, where DT is a predetermined positive torque increment. On the other hand, if processor 100 has found that engine speed is more than the desired speed indicated by control 128, processor 100 may determine that TN should be TC+DT.

In step 242 processor 100 determines how many engine cylinders should be used to produce the desired retarding torque TN. In general, the higher the retarding torque requirement, the more engine cylinders that should be used. However, step 242 may also take into account such factors as engine speed, rate of change of engine speed (acceleration/deceleration), engine cylinder pressure, engine cylinder temperature, and/or turbocharger boost pressure (from steps 224, 226, and 228). This is so because, particularly at higher engine speeds and therefore at higher cylinder and boost pressures, it may be possible to produce a desired amount of engine braking with only some of the engine cylinders. Alternatively, it may be preferable to somewhat suboptimize the timings of the compression release events and use more than the minimum number of engine cylinders, with decreased thermal loading in each cylinder, to produce the desired amount of engine braking. This technique may be used to limit or reduce the load on the parts of the engine brake and engine that cooperate to produce compression release events. At higher engine speeds, peak engine cylinder pressure and turbocharger boost pressure increase and may reach a point at which undesirably large forces are required to open the engine exhaust valves near top dead center at the end of engine compression strokes. Processor 100 can reduce these forces by opening the exhaust valves slightly more in advance of the top dead center condition than is preferable at lower engine speeds and therefore at lower engine cylinder and boost pressures. Advancing the timing of compression release events in this way may somewhat lower the retarding torque produced by each event, but it may also advantageously reduce the load on various engine brake and engine components. Thus, as has been said, processor 100 may take into account considerations such as these in performing step 242.

Step 242 may also take into account such factors as ambient air temperature and/or ambient barometric pressure (from steps 234 and 236). This is so because these factors influence the mass of air received by the engine, and air mass in the engine cylinders influences the amount of engine braking associated with each compression release event. At higher temperatures and/or lower barometric pressures, step 242 may determine that more engine cylinders should be operated in engine braking mode to produce a given amount of engine braking.

Figure 3C:
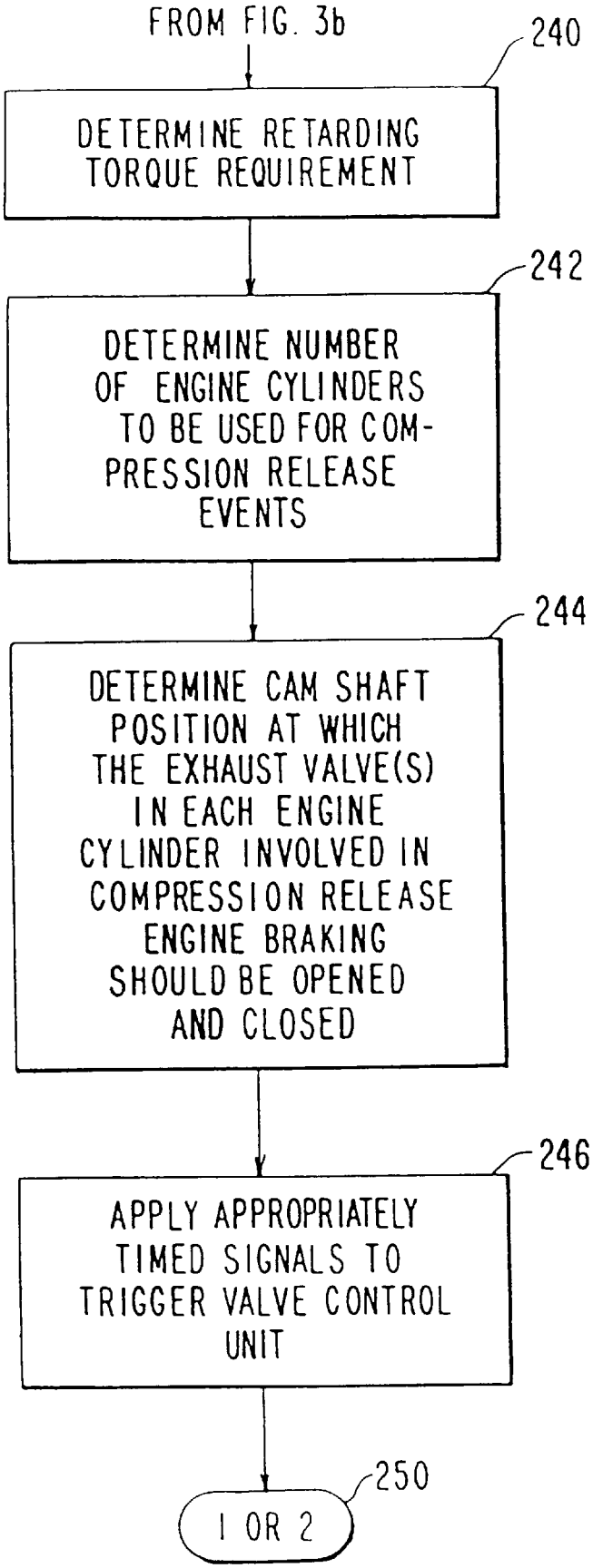
Figure 6:
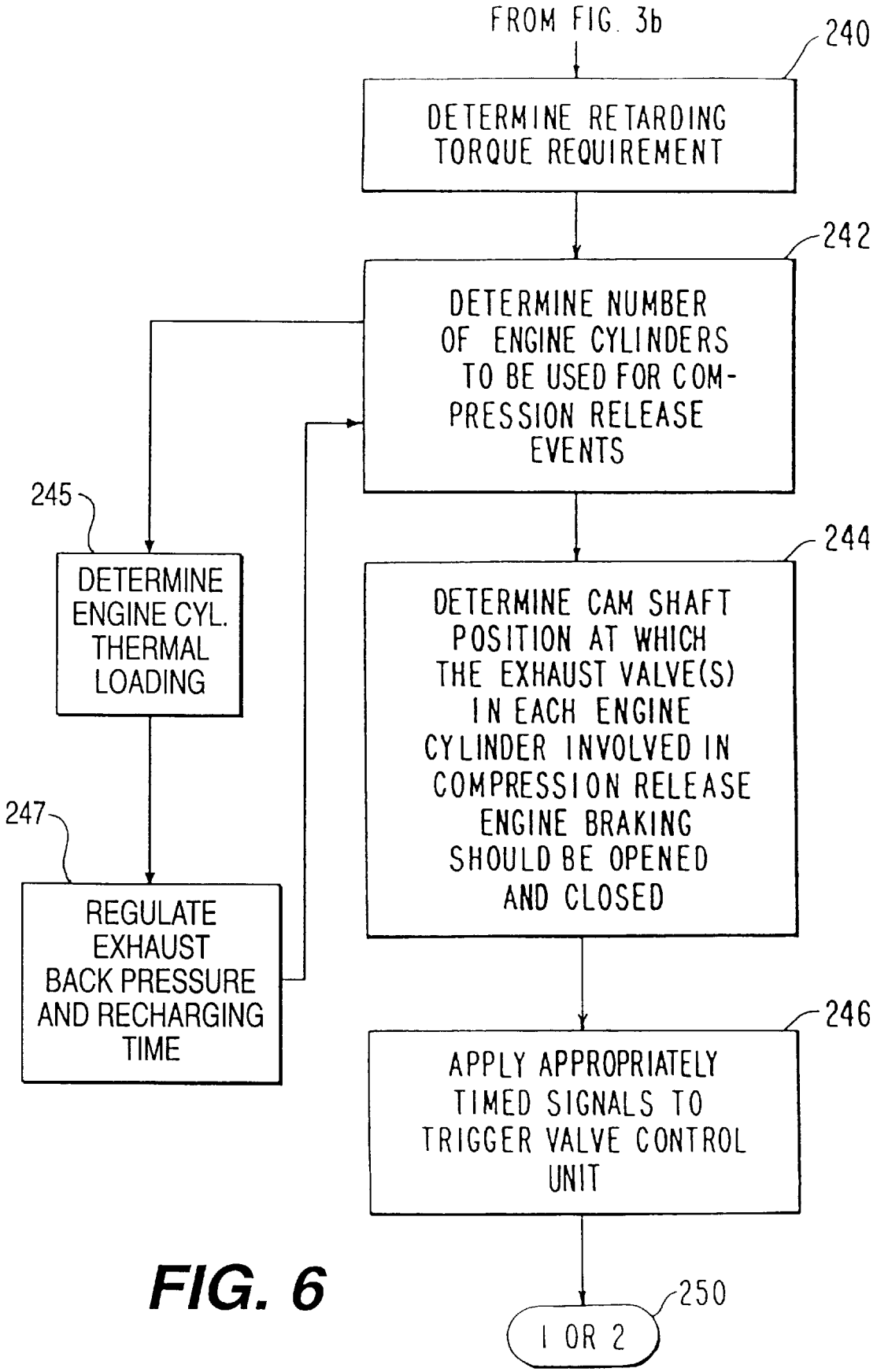
FIG. 6 is an alternative flow chart for that of FIG. 3*c*.

FIG. 6 illustrates an alternative operating sequence to that shown in FIG. 3*c*. With reference to FIG. 6, the operating sequence for the processor 100 at lower engine speeds may include two additional steps to those shown in FIG. 3*c*. At lower engine speeds, higher torque may be required. Accordingly, step 242 may incorporate steps 245 and 247. In step 245, the engine cylinder temperature is monitored and compared to a preset level. If the cylinder temperature exceeds this level, the timing signals which control trigger events may be adjusted to maintain the cylinder temperatures at an acceptable level. In step 247, the exhaust back pressure regulator may be applied at a preset level and exhaust gas recirculation may be controlled with additional controlled trigger events. These additional trigger events may occur at such a point to open the exhaust valve to allow exhaust gas to recharge the engine cylinder. This may further increase the cylinder pressure for greater retarding horsepower.

In step 244 processor 100 determines the timing of the opening and closing of each trigger valve to be used in the engine brake. Once again in step 244 processor 100 may make use of the data derived in earlier steps from sensors 120, 122, 124, 126, 128, 130, 132, and 134, as well as the determinations made as the result of performing steps 240 and 242. From a fixed reference angular position RAP of the engine camshaft, each engine cylinder has its own offset angle OA to the top dead center condition at the end of its compression strokes. For example, cylinder i has offset angle OAi. Processor 100 may open the exhaust valve(s) in each cylinder at a predetermined number of degrees DO before top dead center of the compression stroke. Similarly, processor 100 may close those exhaust valve(s) at a predetermined number of degrees DC after top dead center of the compression stroke. Thus with reference to RAP, processor 100 may open the exhaust valve(s) of engine cylinder i at a camshaft angle OPENAi given by the equation:

$$OPENAi=RAP+OAi-DO \quad (1)$$

Similarly processor 100 may close the exhaust valve(s) of engine cylinder i at a cam shaft angle CLOSEAi given by the equation:

$$CLOSEAi=RAP+OAi+DC \quad (2)$$

Of course, processor 100 can convert equations (1) and (2) to the real-time domain by knowing the real time at which the camshaft is at RAP and by knowing the current speed of the engine and therefore the current rate of rotation of the camshaft. Processor 100 can derive this information from sensors 120 and 122 by performing steps 222 and 224. In this way processor 100 determines (in step 244) when to signal trigger control unit 102 to open and close each trigger valve 104 currently required for engine braking. Step 246 represents the issuance by processor 100 of these signal instructions to trigger valve control unit 102.

Specific methods of determining the signals to open and close the trigger valve to carry out a valve event are provided in the flowcharts included as FIGS. 7, 10 and 11.

In performing step 244 processor 100 may use predetermined nominal values of DO and DC at all times. For example, processor 100 may always use a DO valve of 30° (i.e., 30° prior to top dead center of the compression stroke) and a DC value of 90° (i.e., 90° after top dead center of the compression stroke). Alternatively, processor 100 may vary these values as a function of various engine and vehicle operating conditions monitored by the processor. For example, processor 100 may compute DO in accordance with the following relationship:

$$DO=f(ES, CP, BP, SCS, VS, AAT, ABP, CT, EBP) \quad (3)$$

where ES is engine speed (derived from sensor 122 in steps 224), CP is engine cylinder pressure (derived from sensor 124 in step 226), BP is turbocharger boost pressure (derived from sensor 126 in step 228), SCS is a speed control setting (derived from sensor 128 in step 230), VS is vehicle speed (derived from sensor 130 in step 232), AAT is ambient air temperature (derived from sensor 132 in step 234), ABP is ambient barometric pressure (derived from sensor 134 in step 236), CT is cylinder temperature (derived from sensor 111), and EBP is exhaust back pressure (derived from sensor 113). In particular, processor 100 may increase DO as any of ES, CP, BP, SCS, VS and ABP increase, and may decrease DO as any of these parameters decrease. On the other hand processor 100 may increase DO as AAT decreases, and may decrease DO as AAT increases.

Increasing DO advances each compression release event relative to top dead center of the associated compression stroke. This tends to decrease the retarding torque produced, but it also tends to reduce the forces required to open the exhaust valves. As mentioned earlier, this may be desirable to prevent undesirably high stresses in the components involved in producing compression release events at high engine speeds and pressures, at low ambient air temperature, and/or at high ambient barometric pressures.

Decreasing DO retards the compression release events relative to top dead center of the compression strokes, thereby tending to increase the retarding torque produced. This may be permissible at lower engine speeds and pressures, at high ambient air temperatures, and/or at low ambient barometric pressures.

By way of illustration, processor 100 may automatically vary DO through a range from about 40° to about 20° before top dead center of the compression strokes of the engine using expression (3). The relationship of DO to CT and EBP may depend upon engine configuration. For example, if CT exceeds a predetermined limit, DO may be reduced by reducing EBP. The ability to reduce EBP is important in engines in which EBP and CT are directly related, that is where the higher the EBP, the higher the CT.

Figure 4:
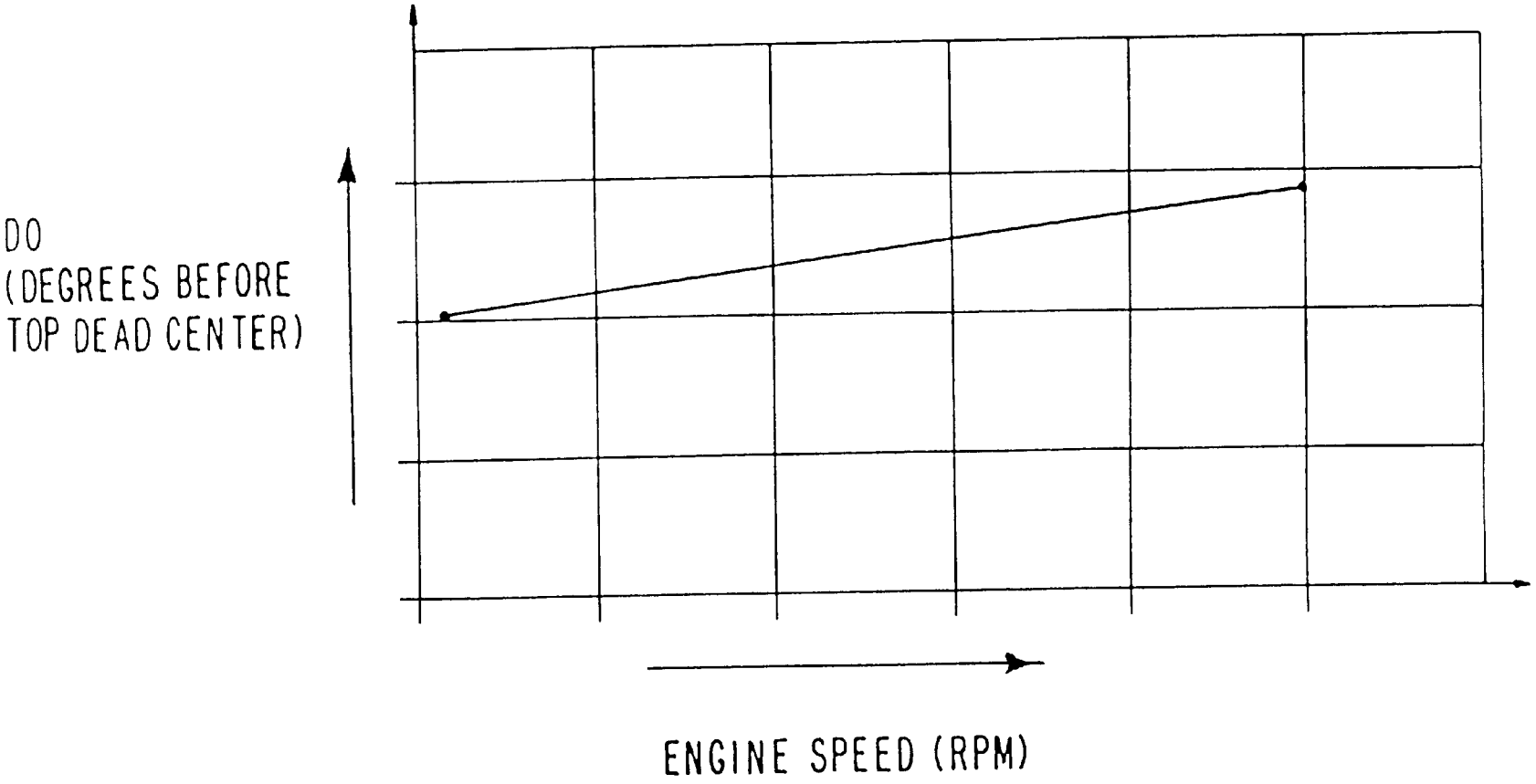
FIG. 4 is an illustrative diagram of control data that can be stored as a look-up table in a portion of the apparatus shown in FIG. 2 and used during the operating sequence of FIG. 3 in accordance with this invention.

Processor 100 may automatically vary DO as described above by performing a calculation of the type represented by expression (3). Alternatively, processor 100 may use one or more of the parameters on the right-hand side of expression (3) as address information to look up appropriate corresponding values of DO previously stored in a look-up table memory which is part of processor 100. FIG. 4 is an illustrative example of such a look-up table based on engine speed.

The operating sequence shown in FIG. 3 ends at step 250, which returns control to either step 202 or step 222. For example, step 250 may cause control to return to step 222 most of the times that step 250 is reached, with control being returned to step 202 somewhat less frequently (e.g., approximately once per second). Return to step 222 will automatically continue operation of the engine brake. Return to step 202 causes processor 100 to check whether continued engine braking is appropriate, and if not, to turn off the engine brake via performance of step 204.

With reference to FIGS. 11*a*–11*h* (collectively referred to as FIG. 11) a flow chart illustrating an engine retarder control sequence is provided. The steps illustrated by the flow chart in FIG. 11 may be carried out using the electronic controls of FIGS. 2 and 5 (the "system"), which may include a microcontroller. As shown in FIG. 11, the system may be initialized (step 300), all timers cleared (step 310), and the engine confirmed to be running at a sufficient speed for braking. Sufficient engine speed for braking may be indicated by an engine speed above 1000 RPM (step 320).

Next, the system may wait for a synchronization signal (step 330). Synchronization signals may be provided by a camshaft position sensor. The synchronization signals indicate each time the camshaft makes a complete revolution. The system knows the locations of each piston at the time the synchronization signal is detected, and therefore, detection of the synchronization signal may be used to synchronize engine braking events with the actual piston locations.

If engine RPM's are sufficient and after a synchronization signal is detected by the system, the system may determine instantaneous piston locations between occurrences of the synchronization signal using a crankshaft position sensor. The crankshaft position sensor may provide engine location signals (steps 340 and 370), which indicate that the engine has rotated through a fix number of degrees since the last engine location signal was detected. Particular engine location signals may indicate the times at which each of the pistons in the engine attain some predetermined position, such as top dead center.

The last two known engine positions may be used to determine a close approximation of the instantaneous engine speed. Knowledge of the instantaneous engine speed, as well as the engine position, enables the system to determine the delay (steps 770 and 790) between the present time and the next time a valve needs to be opened or closed to carry out a called for valve event. To determine the delay, the system may calculate how long it will take the engine to arrive at a desired location based on how long it takes it to travel through the last two known positions. The appropriate delay may be read from a look-up table. The looked-up delay may be further modified (i.e. valve events may be advanced or retarded) based on other engine parameters, such as those mentioned above. This delay also may be re-determined over and over until the delay is up and the valve event is called for, in order to account for changes in engine speed over time.

The system may discriminate between engine location signals corresponding to top dead center for each of the different pistons using the synchronization signal. The synchronization signal (step 330) provided by the camshaft position sensor enables the system to identify which piston is where. Once the system knows which piston is where, it can synchronize each pistons reaching top dead center with the correct engine location signal.

Each time the system detects a new engine location signal (steps 340 and/or 370), then the system may also check to determine whether any synchronization error exists (step 600). A synchronization error occurs when the number of actual engine location signals between two occurrences of the synchronization signal does not agree with the expected number of engine location signals for this interval. For example, a six cylinder engine may provide six engine location signals per cycle of the engine. I.e., there are six "piston at top dead center" occurrences between two occurrences of the synchronization signal. If the system detects more or less than six engine location signals between two occurrences of the synchronization signal, then a synchronization error has occurred. A synchronization error may result in the system returning to initialization (step 310).

If there is no synchronization error when it is checked for, then the system may determine whether engine speed is too high or too low to institute engine braking. For example, if the engine speed is greater than 2600 RPM (step 610) then the brake may be turned off (steps 630 et. seq.), or if the engine speed is less than 1000 RPM (step 620) then the brake may be turned off (steps 640 et. seq.).

If engine speed is compatible with engine braking, then the system may confirm that the engine is in braking mode, and not in positive power mode (step 680). If the engine is in positive power mode, then a comparison may be carried out between the EGR timers (registers) and a system clock (step 690). If it is time for an EGR event, then the system carries it out following the routine provided by steps 700 et. seq. If it is not time for an EGR event, then the system returns to step 340 to check for an engine location signal.

If the system is determined in step 680 to be in braking mode, then the system may confirm that braking mode has not been manually overridden (step 730). If braking has been manually turned off, then the brake is turned off (step 740) and the system returns through steps 660 et. seq. to step 340 to check for an engine location signal. If braking has not been manually overridden, then a comparison may be carried out between the braking timers (registers) and the system clock (step 750) to determine if it is time for a braking event.

If it is time to schedule an upcoming braking event, then the system may calculate instantaneous engine speed, calculate the delay before the valve should be opened based on instantaneous engine speed and position, and calculate the duration of the event (step 790). The system may use input from the other sensors to adjust the delay and duration times calculated in step 790. Following these calculations, and based thereon, the system may set flags in storage registers (step 800), which when read (steps 370 et. seq.), will trigger valve opening and closing at the proper times for the braking event. The system may include a memory means that includes two or more registers for storing delay and duration times. It may be useful to have at least four registers for storing these times because the delay and duration times for different valves may routinely overlap.

If no braking event is called for but the system is in braking mode, then a comparison may be carried out between the EGR timers and the system clock (step 760) to determine if it is time for an EGR event. If it is time for an EGR event, then the system may calculate instantaneous engine speed, calculate the delay before the valve should be opened based on the engine speed, and calculate the duration of the event (step 770). Based on these calculations, the system may set flags in storage registers (step 780), which when read (steps 370 et. seq.), will trigger valve opening and closing for the EGR event.

Between times when the system is opening or closing a valve, or synchronizing an engine location signal, the system may cyclically determine whether timers have been loaded with a delay time that will trigger a valve event, such as a compression release engine braking event or an EGR event. If timers have not yet been loaded, then the system may cycle between checking for an engine location signal (step 340) and checking the timers to determine if times have been loaded (steps 350 and 360).

If the timers are running, i.e. loaded with a delay or duration time (step 360), then the system may switch over to cycling between checking for an engine location signal (step 370) and comparing the times stored in the timers with the system clock. Based on matches between the times stored in the timers and the system clock, the system may trigger a valve to open (steps 420 and 520) or trigger a valve to close (steps 430 and 530). The starting time and duration of the valve event may be controlled by using the processor to determine whether the appropriate delay (steps 400 and 500) has elapsed before the beginning of the valve event, and whether the duration (steps 410 and 510) of the valve event has ended. When the delay is first determined to have elapsed, the valve may be triggered to open 420 or 520. When the duration of the valve event is first determined to have ended, the valve may be triggered to close 430 or 530.

When a timer is active, but it is not yet time to open or close a valve in association with the active timer then the system may continue to check for a match indicating it is time to open or close a valve. If no timer is active, the system may return to step 340, in which case the system may not check for active timers again until the timers are indicated to have been loaded.

Figure 7A:
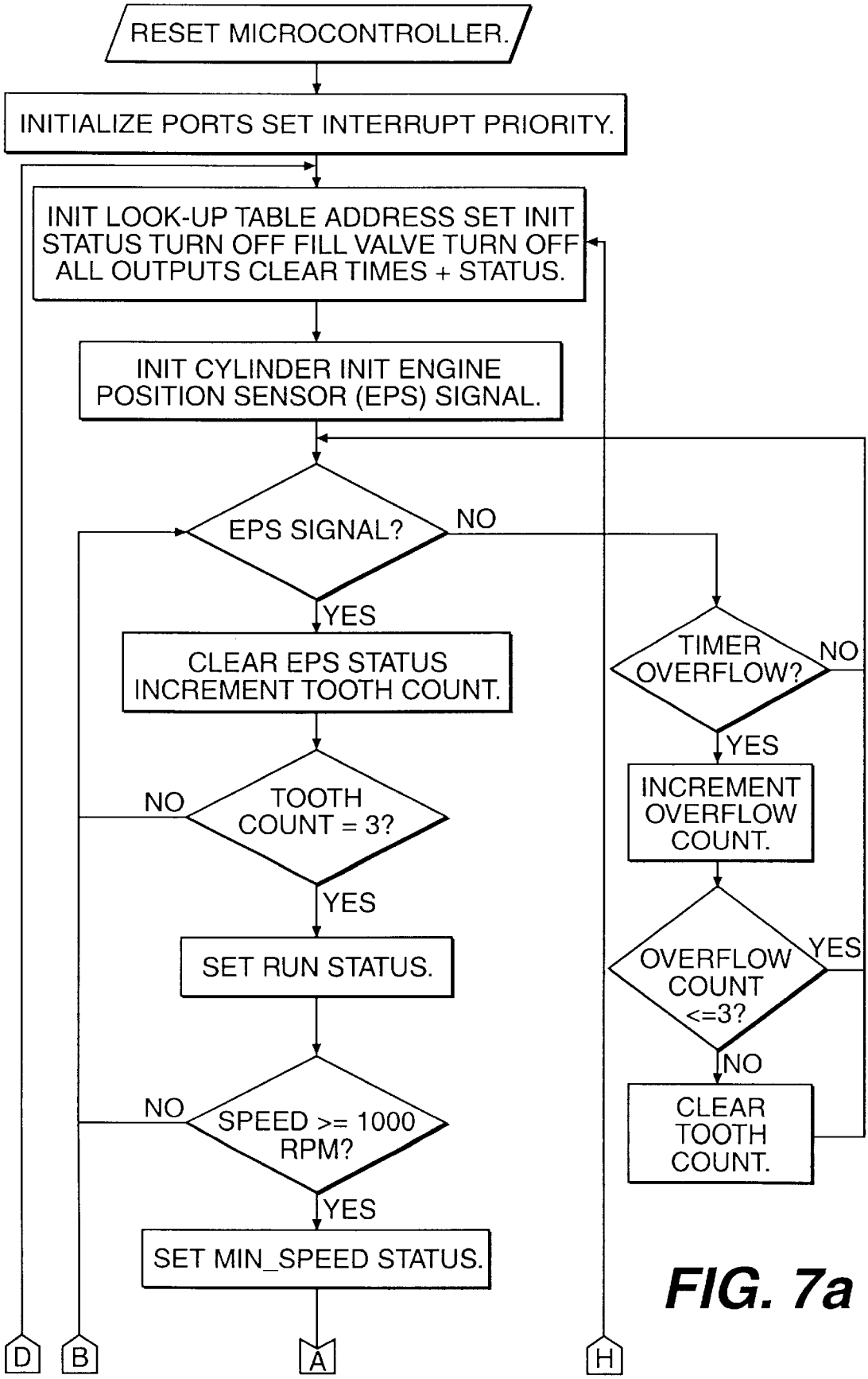
Figure 7C:
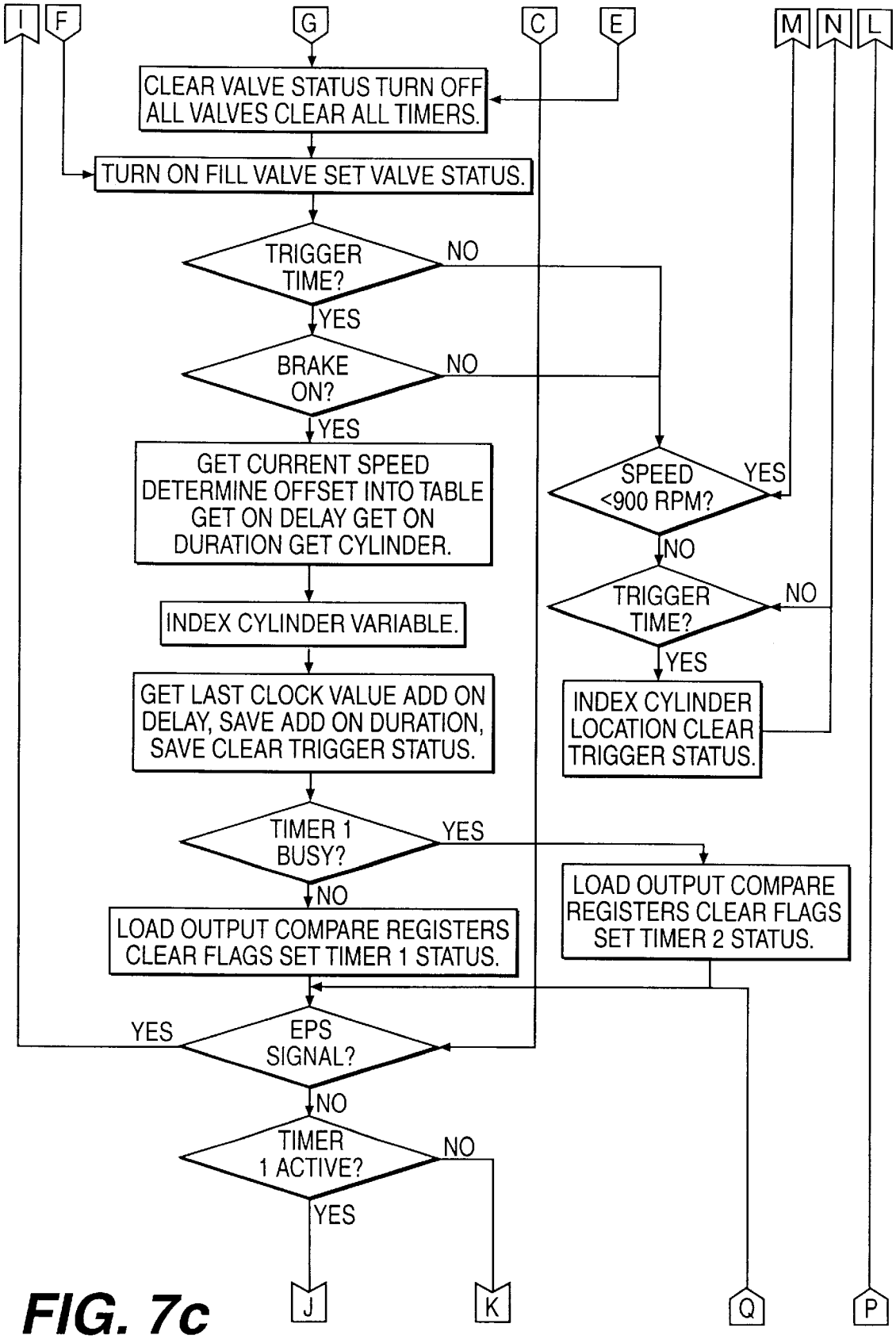
Figure 7D:
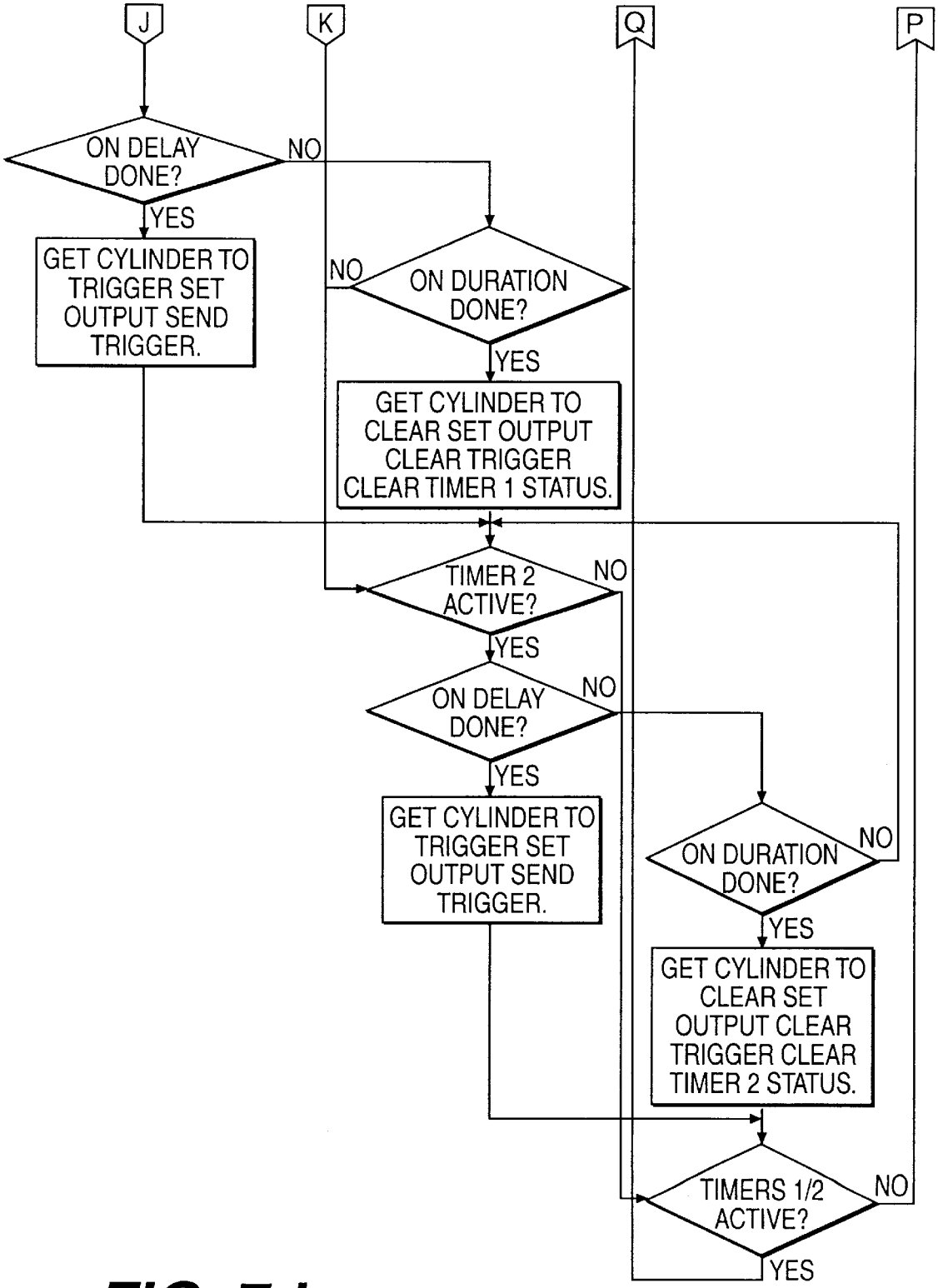

An alternative routine useful in carrying out the invention is illustrated by the operating sequence shown in FIGS. 7*a*, 7*b*, 7*c* and 7*d* (collectively FIG. 7). The routine illustrated in FIG. 7 is similar in many respect to that of FIG. 11. The engine position signals (EPS signals) used in the routine of FIG. 7 may be generated in accordance with the routine shown in FIGS. 8*a* and 8*b* for generating TRS signals. The synchronizing signals (sync signals) used in the routine of FIG. 7 may be generated in accordance with the routine shown in FIG. 9 for generating SRS signals.

Figure 8A:
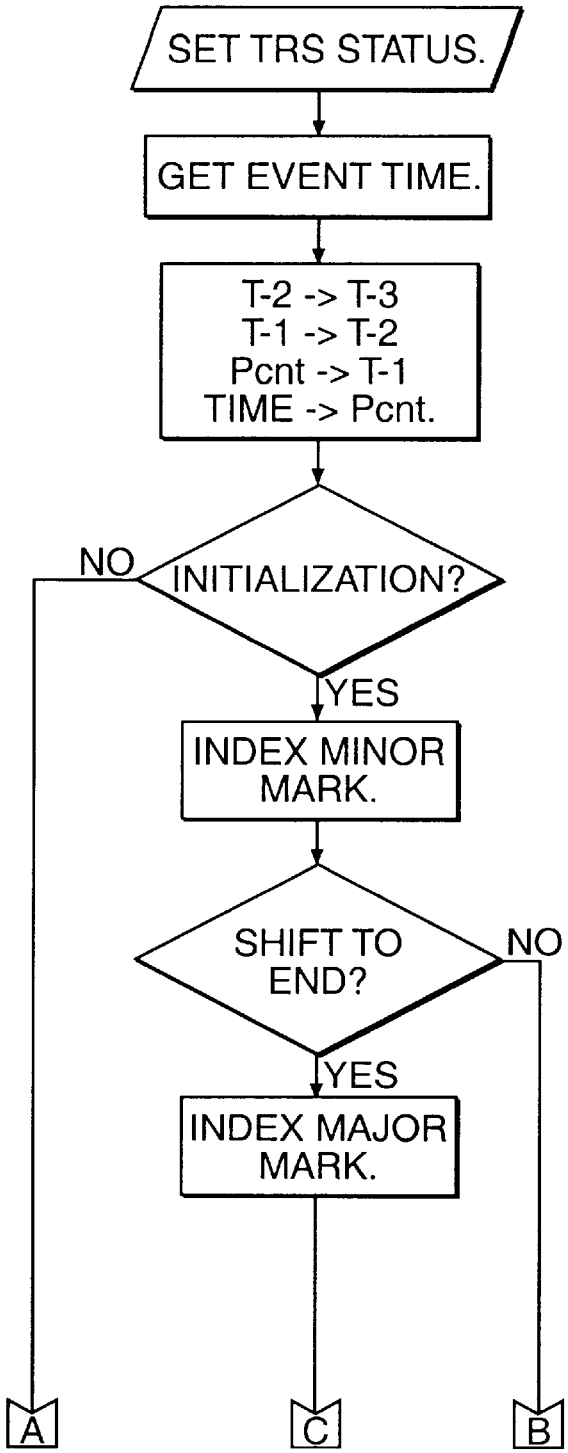
FIGS. 8*a* and 8*b* (collectively referred to as FIG. 8) is a flow chart illustrative of a timing reference signal routine of the invention.
Figure 8B:
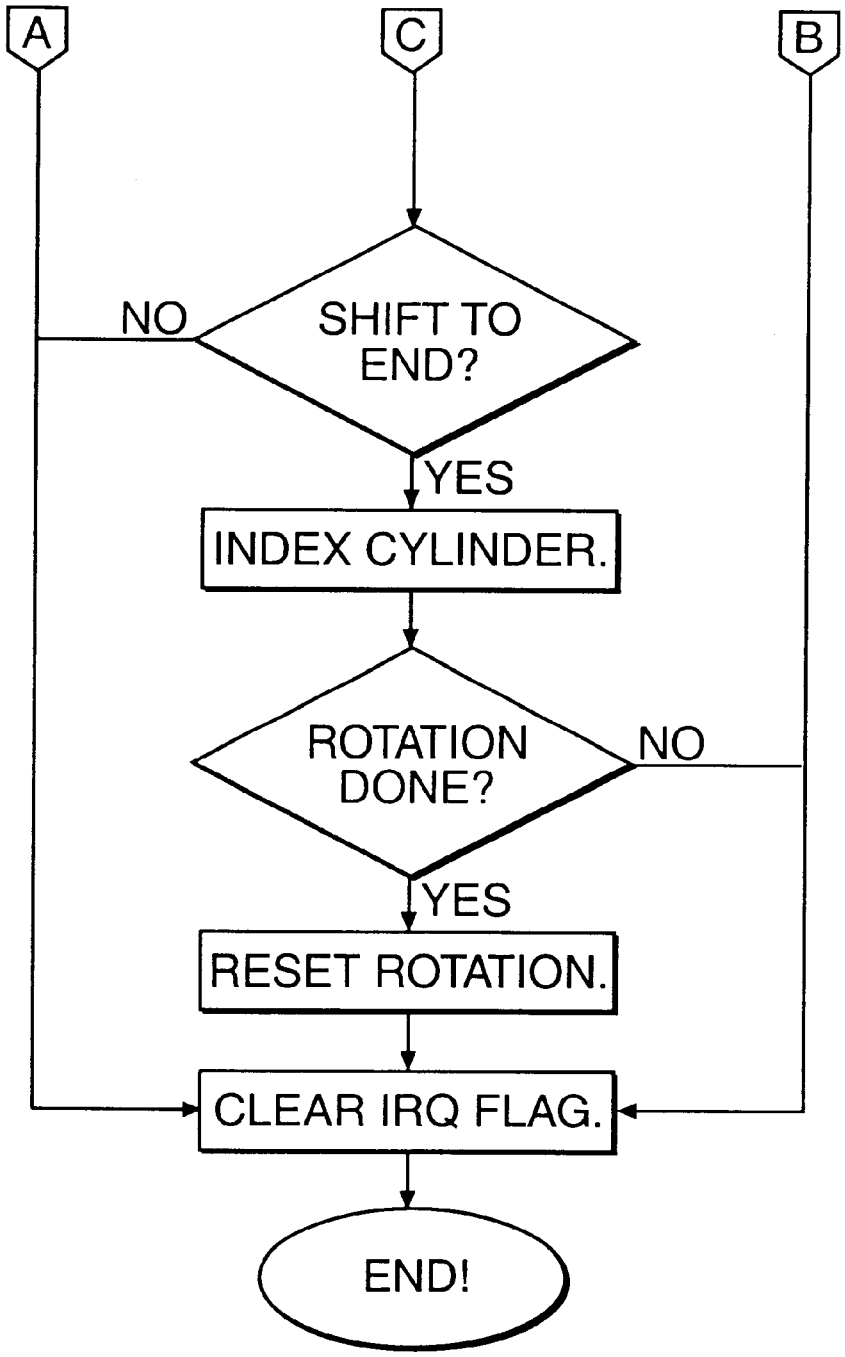

FIGS. 8*a* and 8*b* show a routine for determining Timing Reference Signals (TRS) from a sensor located on an engine timing gear. The timing signals may be produced in response to the passage of a tooth on the timing gear past a fixed point. The timing signals produced in the routine of FIGS. 8*a* and 8*b* may provide interrupts for the routines shown in FIGS. 7 and 10.

Figure 9:
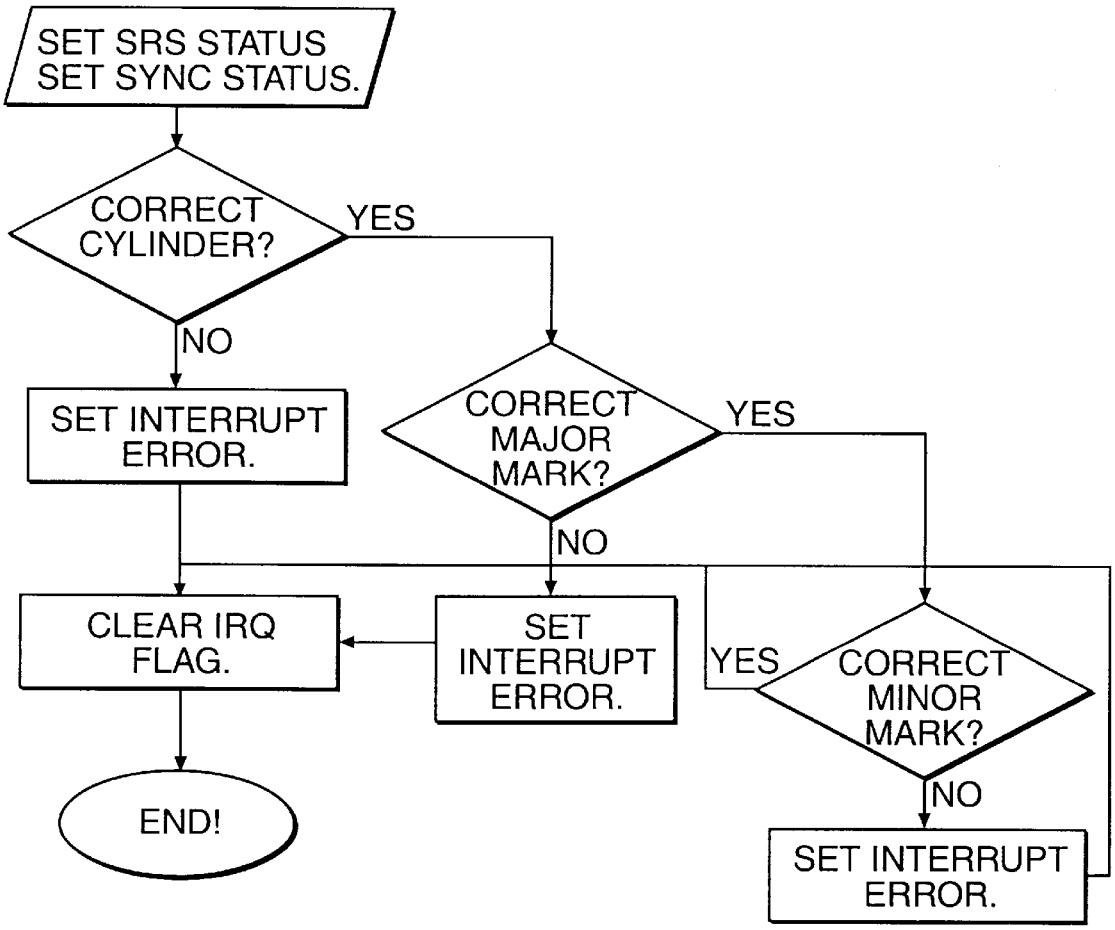
FIG. 9 is a flow chart illustrative of a synchronous reference signal routine of the invention.
Figure 10A:
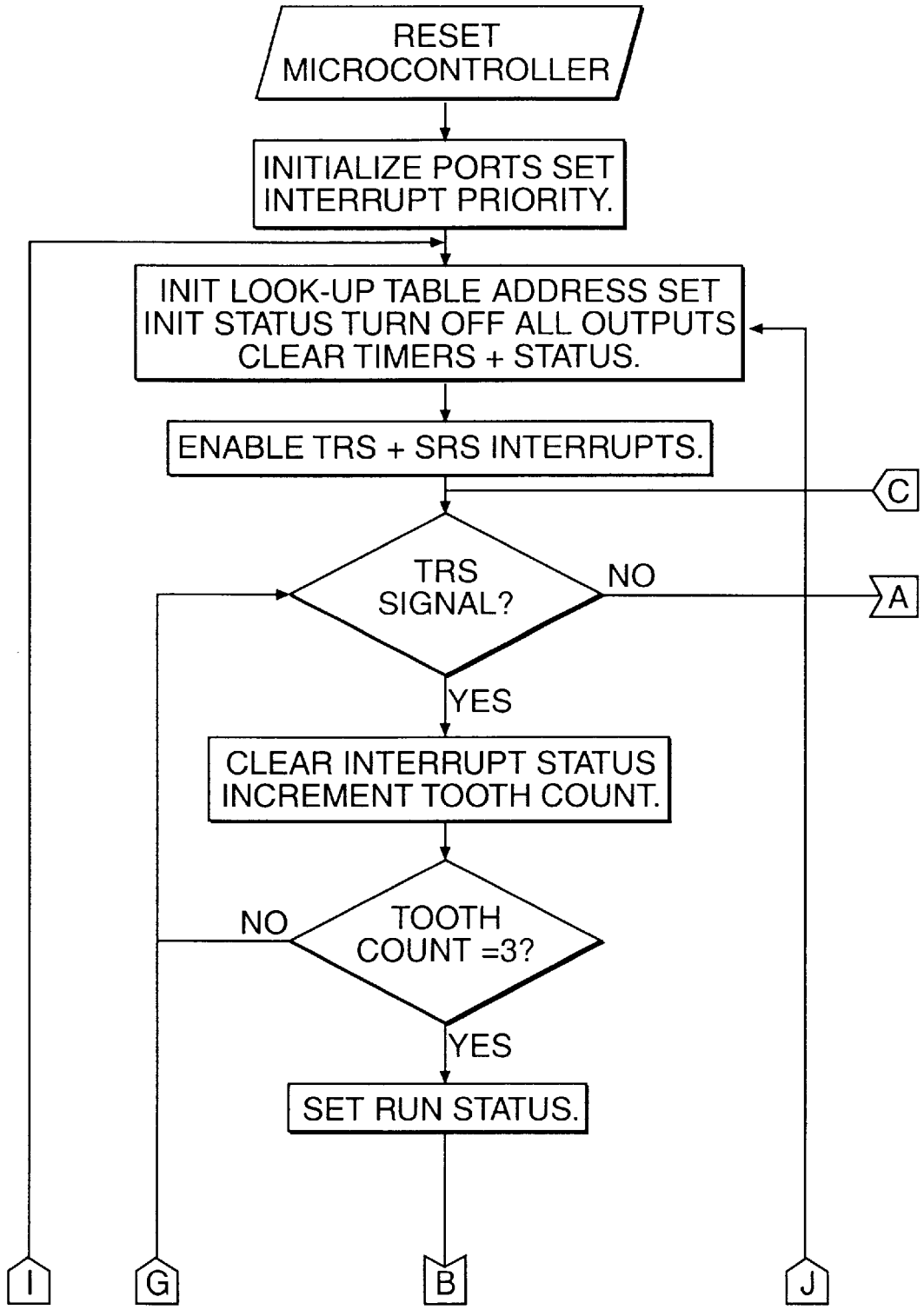
FIGS. 10*a*, 10*b*, 10*c*, 10*d*, 10*e*, 10*f*, 10*g*, 10*h*, 10*i*, 10*j*, and 10*k* (collectively referred to as FIG. 10) is a flow chart illustrative of a second engine brake operating sequence of the invention.
Figure 10B:
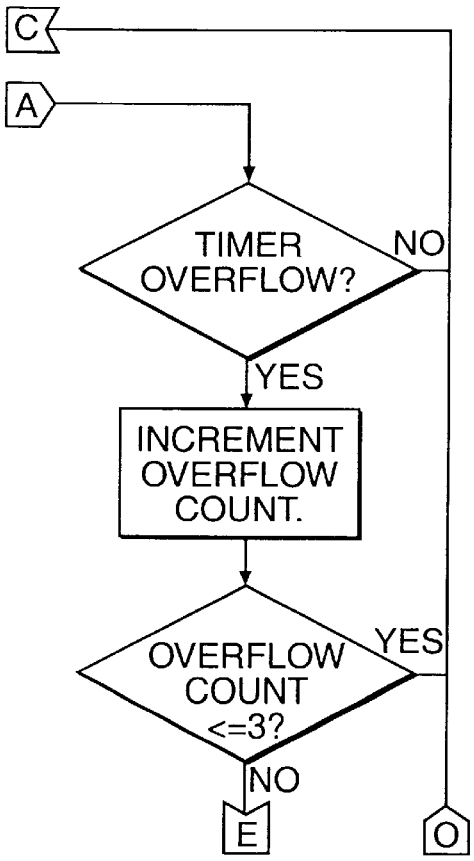
Figure 10C:
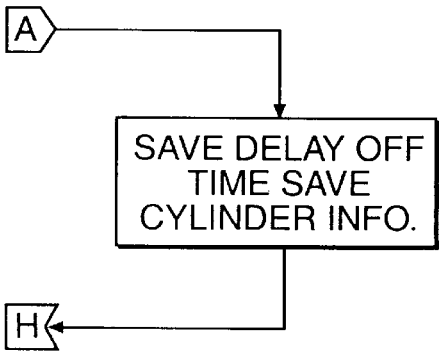
Figure 10D:
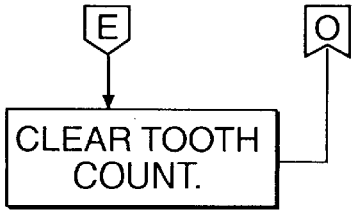
Figure 10E:
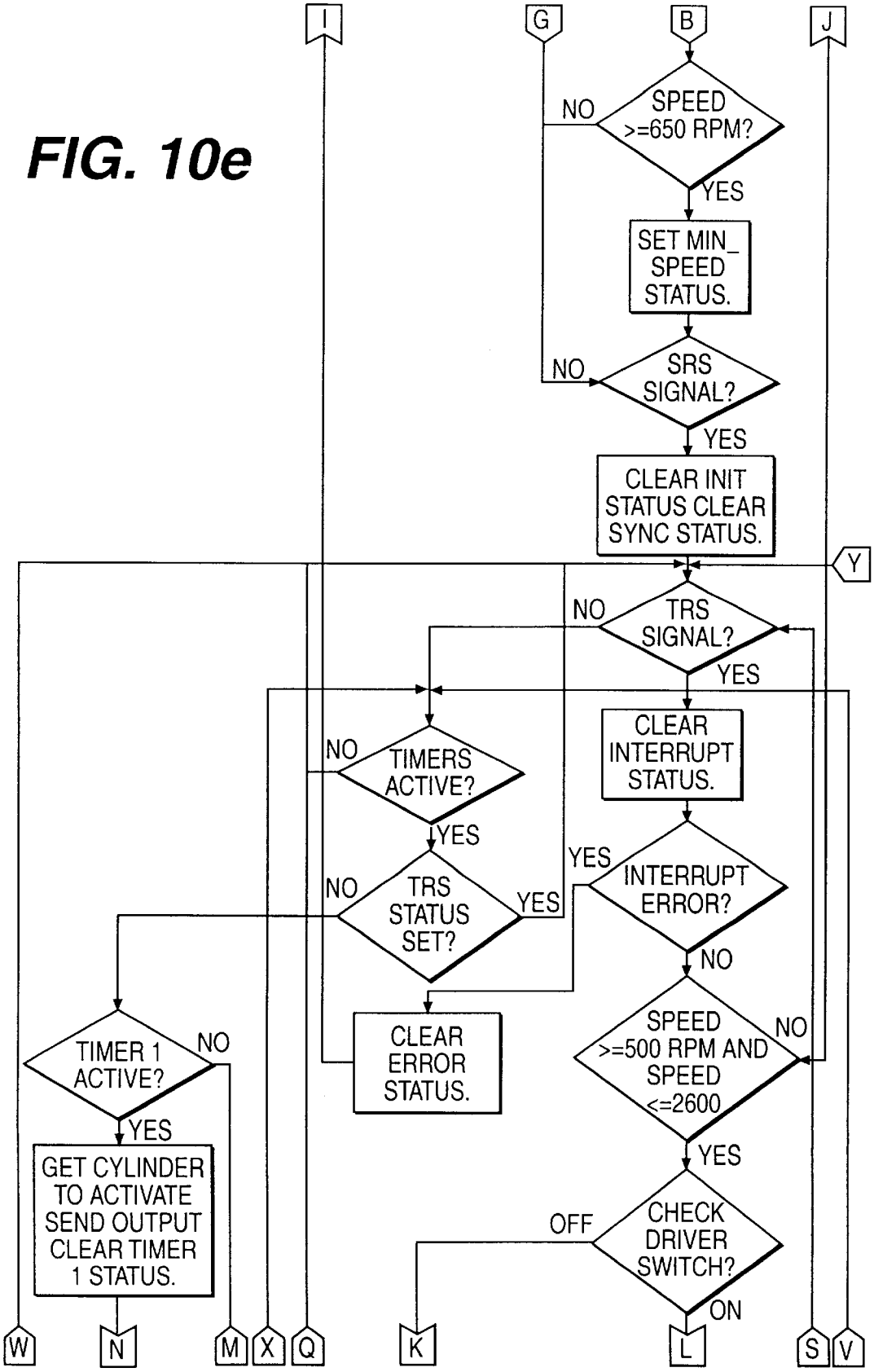
Figure 10F:
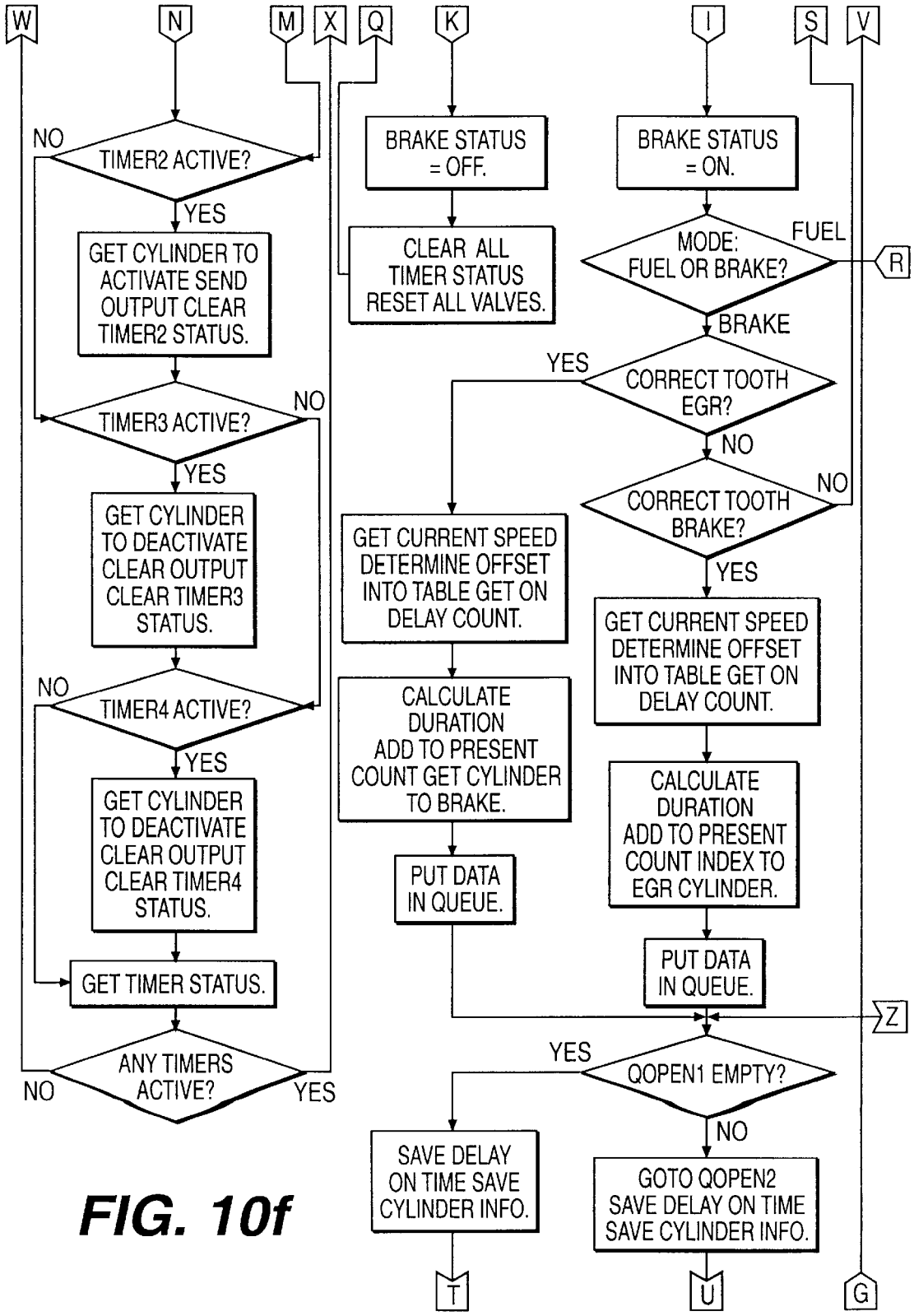
Figure 10G:
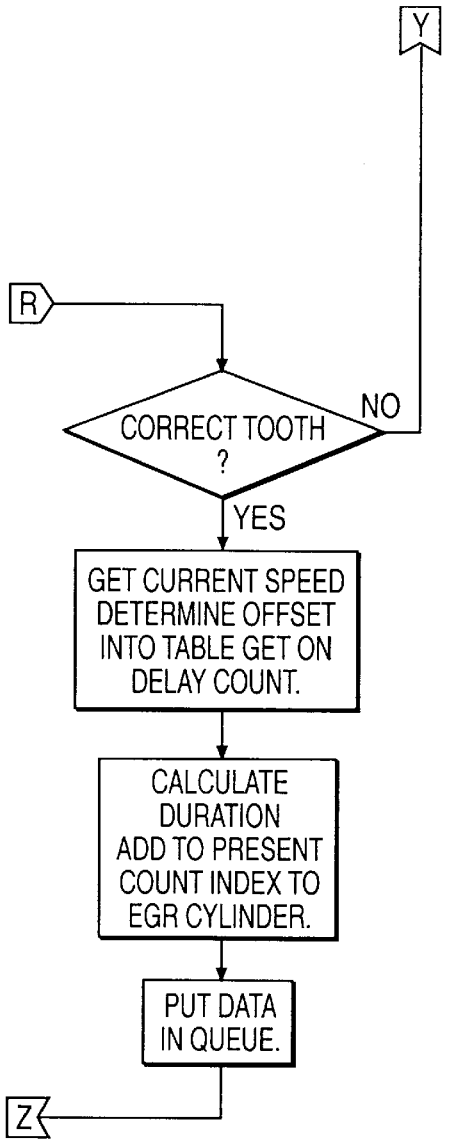
Figure 10H:
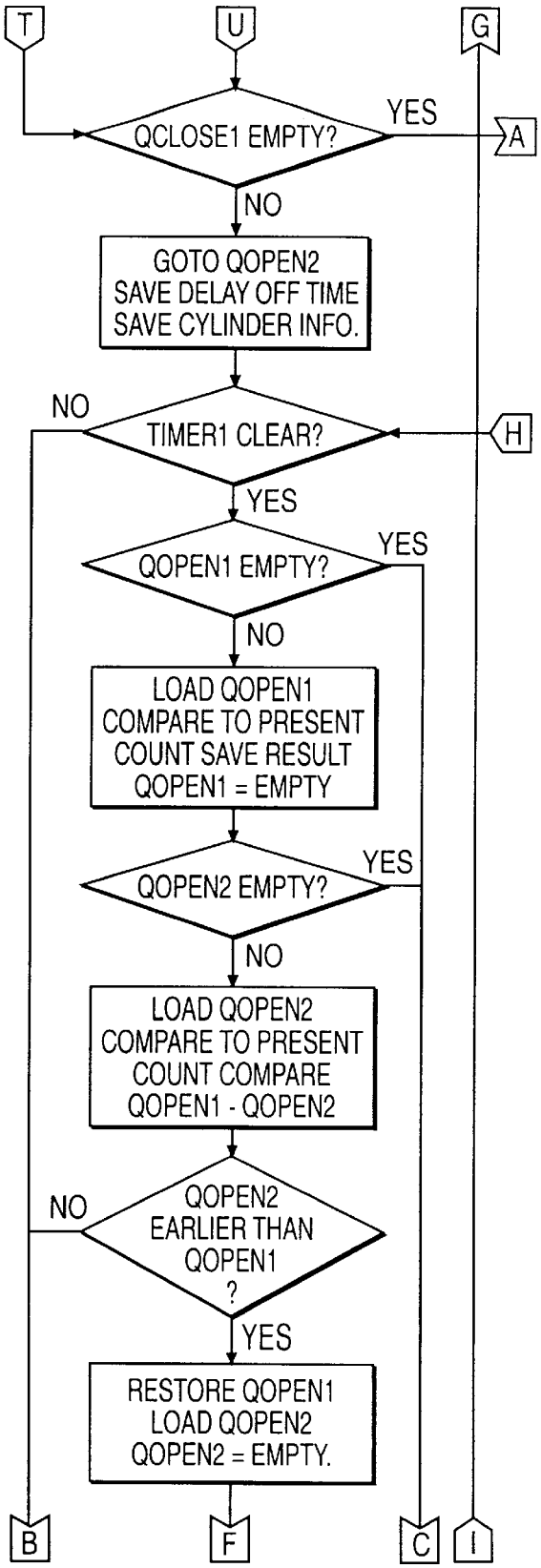
Figure 10I:
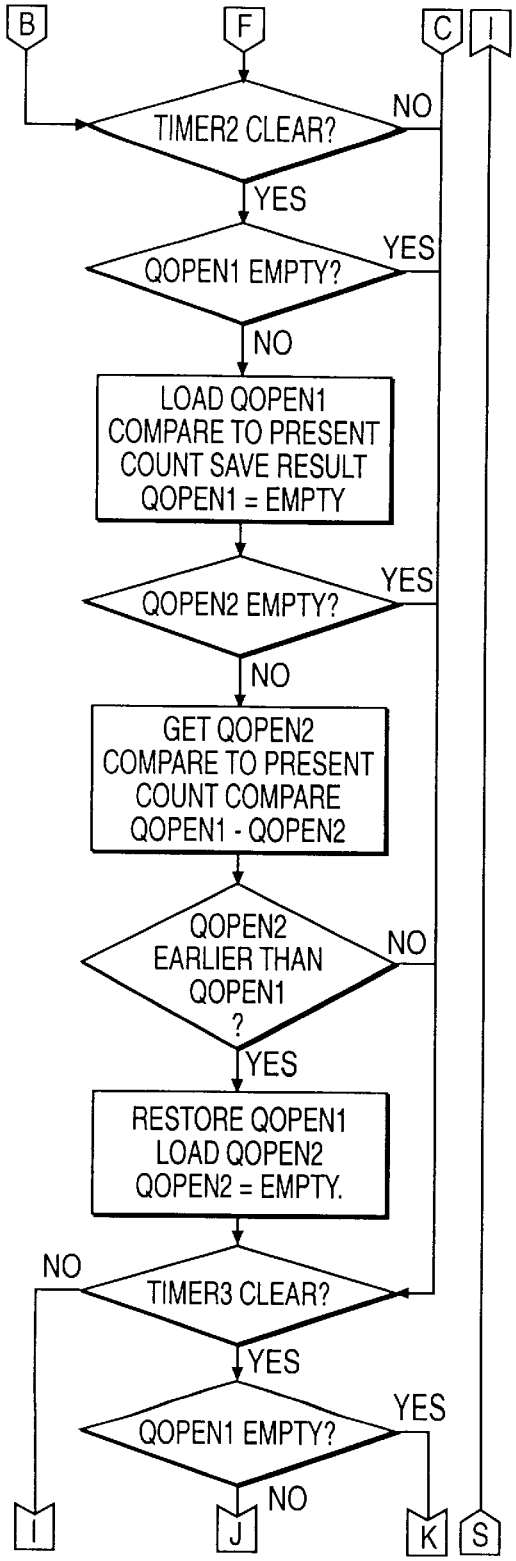
Figure 10J:
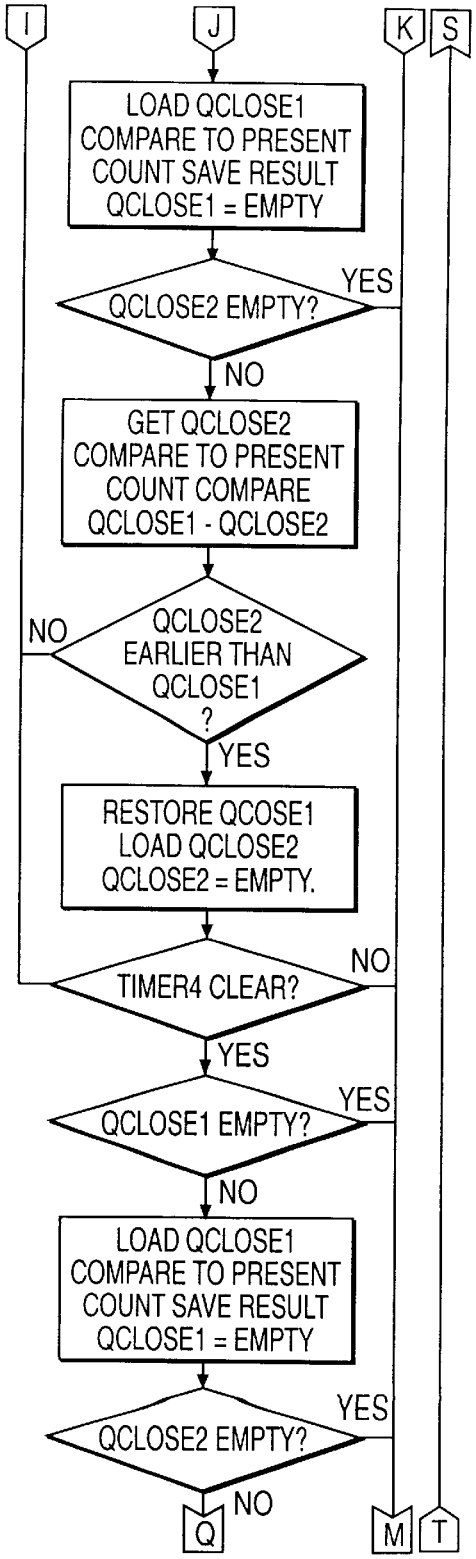
Figure 10K:
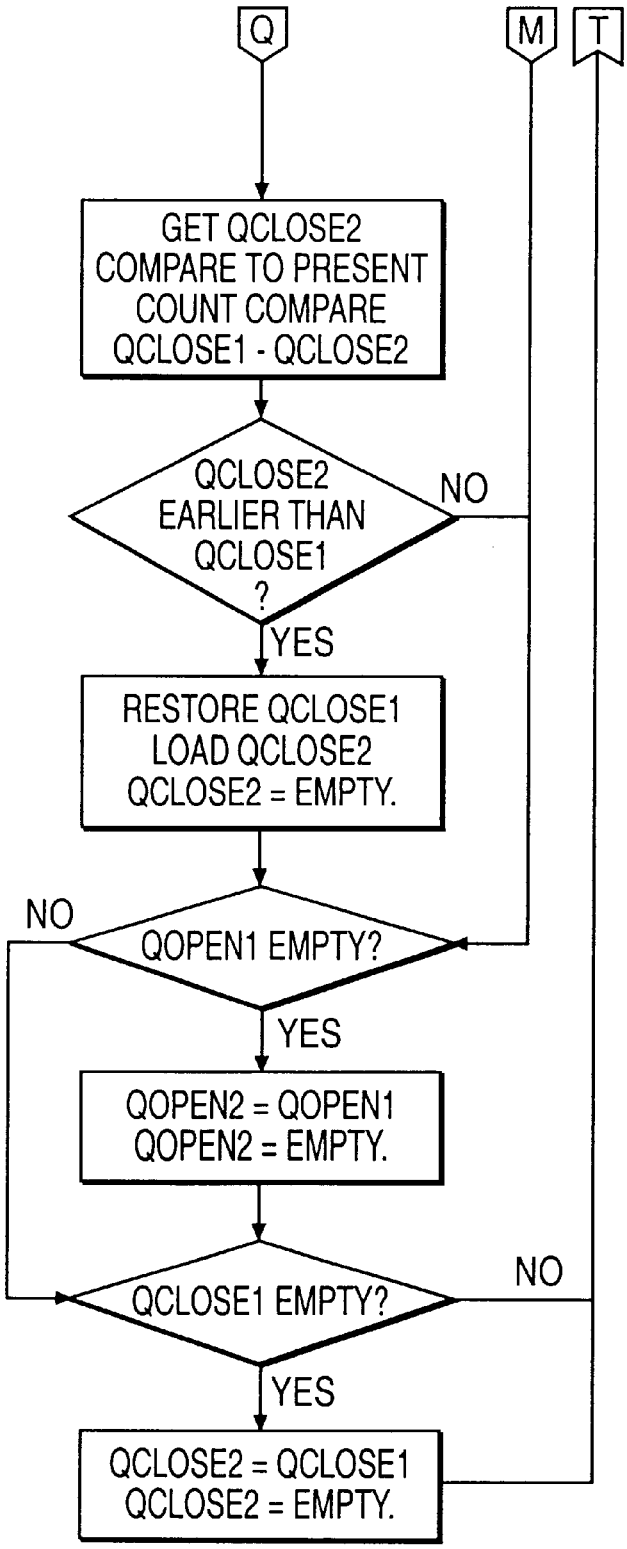
Figure 11A:
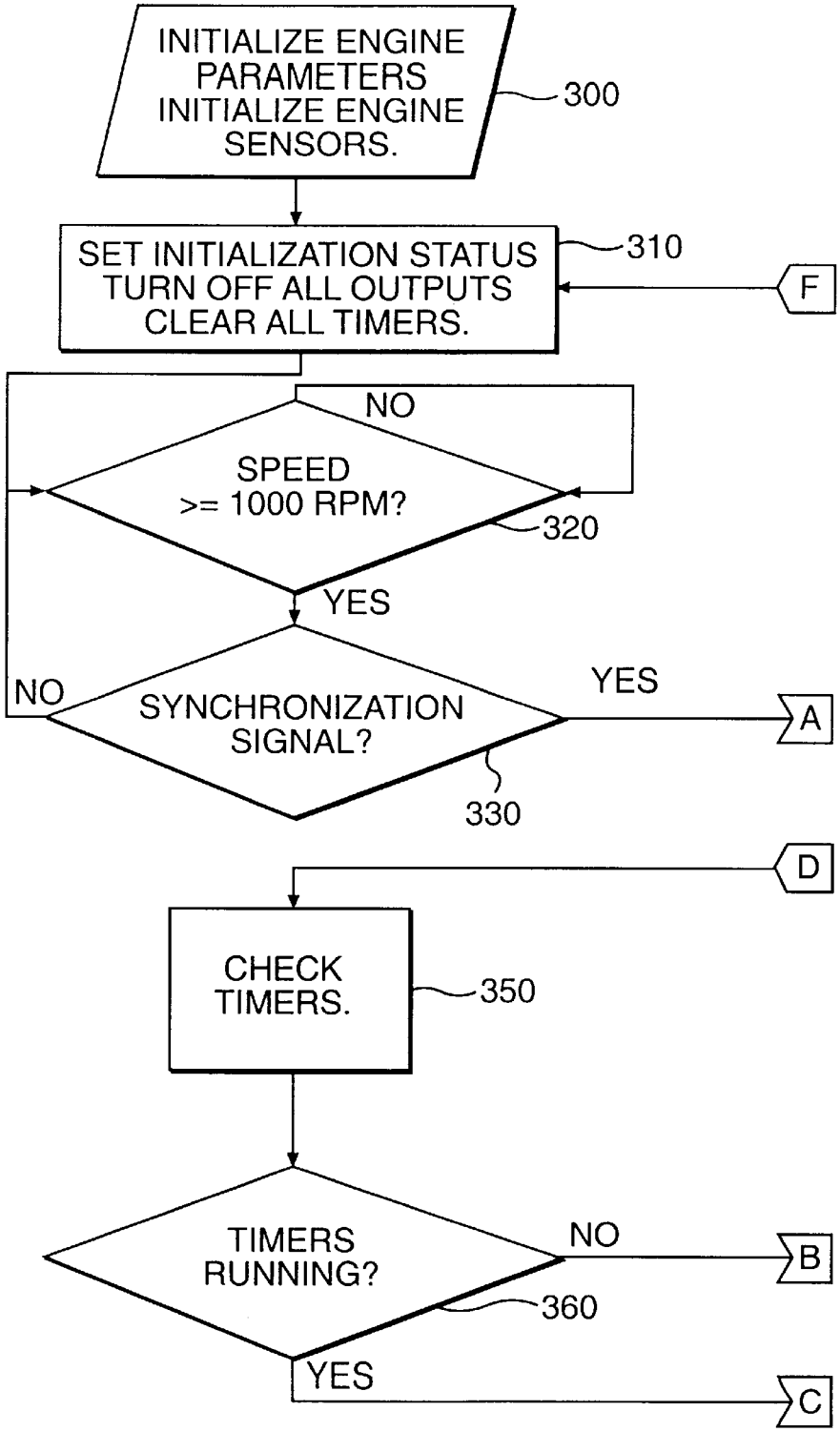
FIG. 11*a*, 11*b*, 11*c*, 11*d*, 11*e*, 11*f*, 11*g*, and 11*h* (collectively referred to as FIG. 11) is a flow chart illustrative of a preferred engine retarder operating sequence of the invention.
Figure 11B:
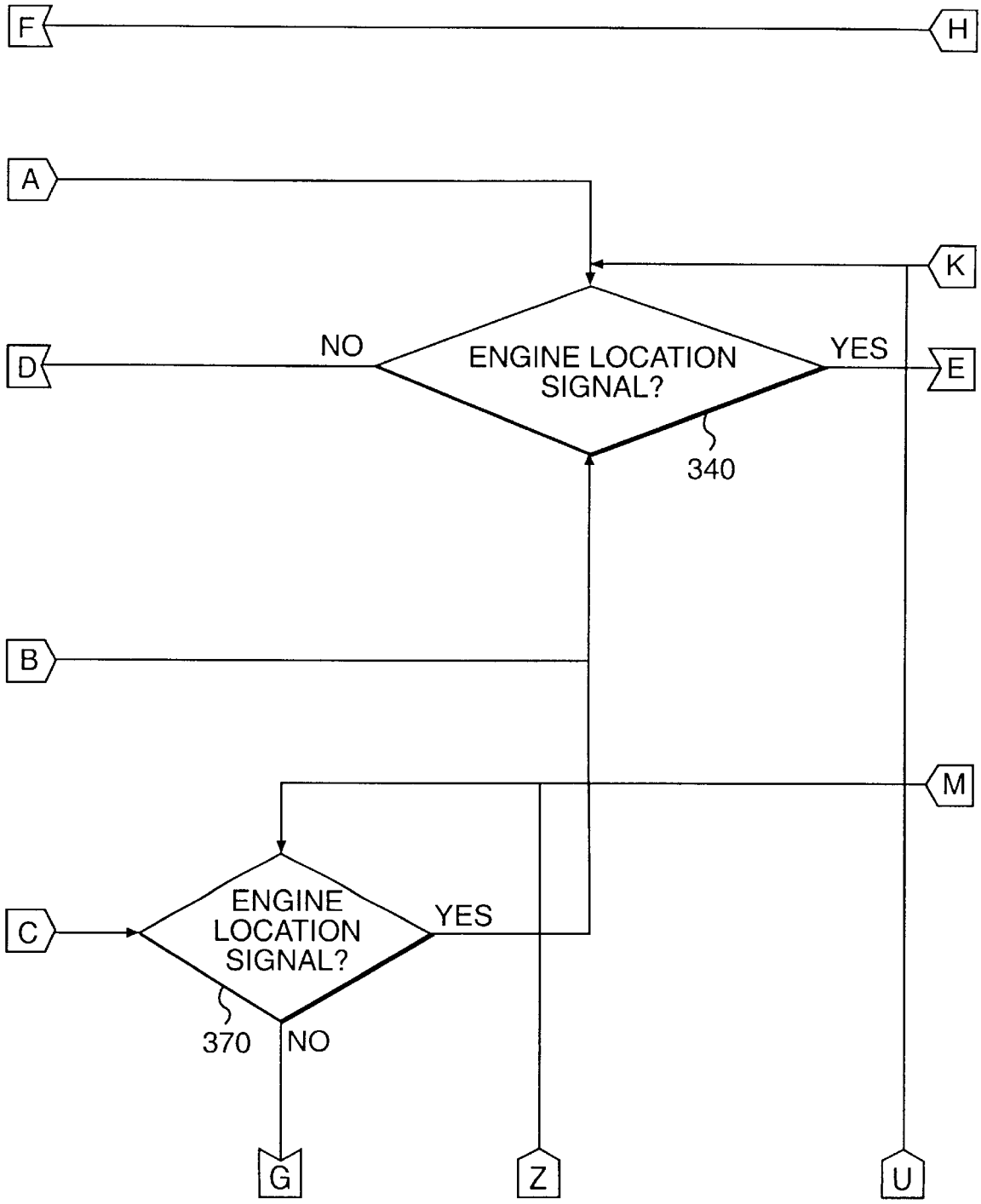
Figure 11C:
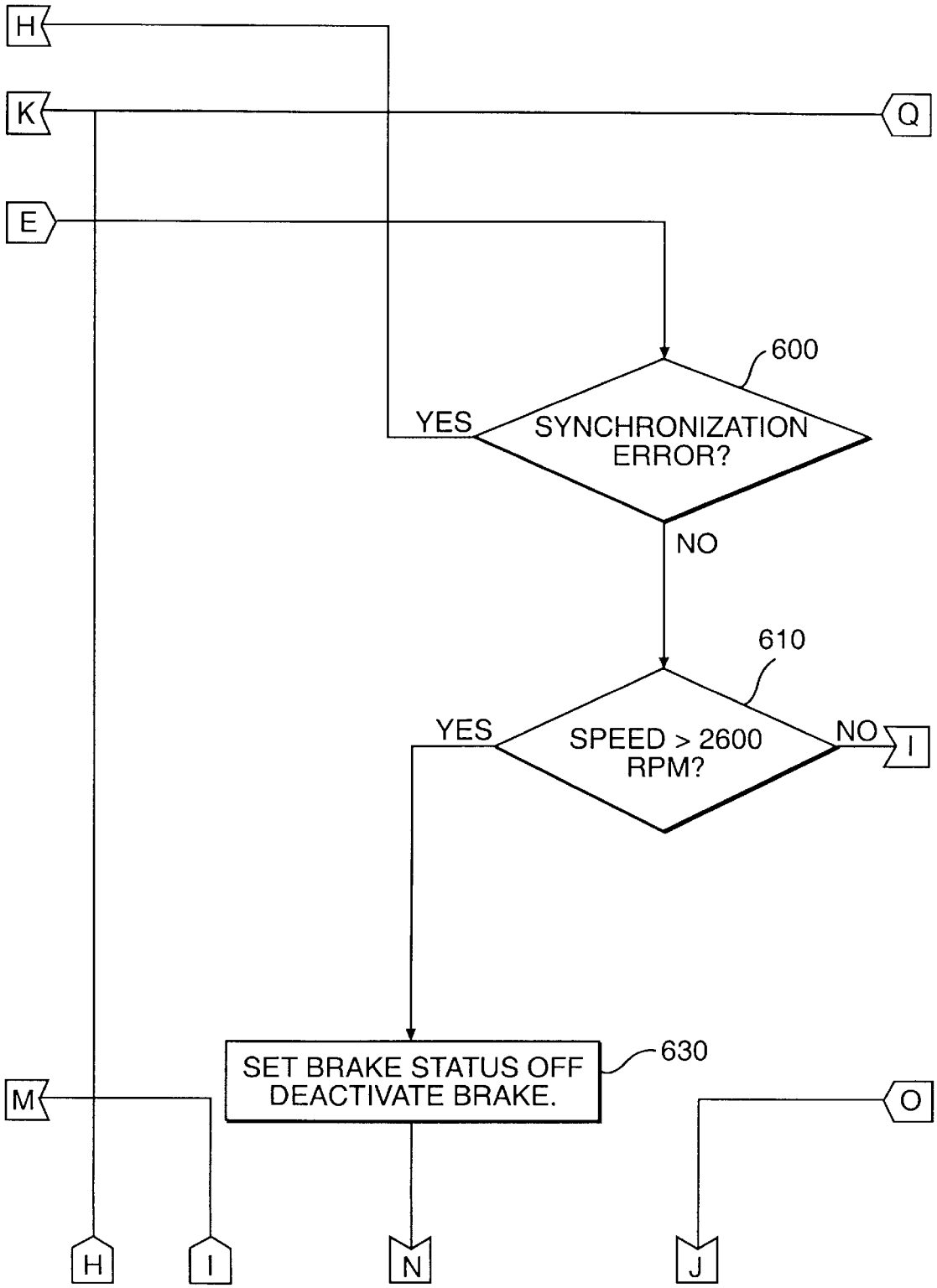
Figure 11D:
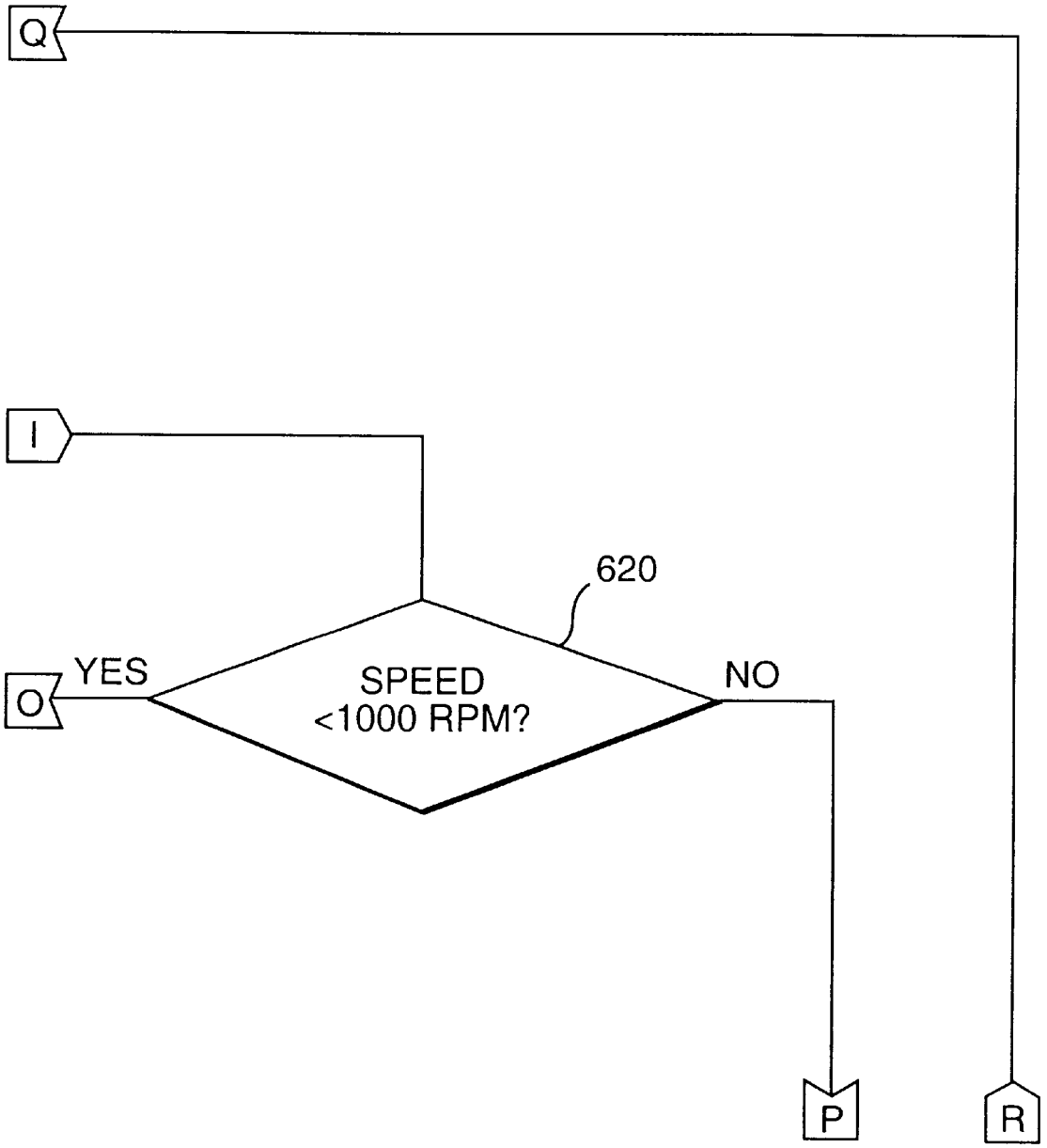
Figure 11E:
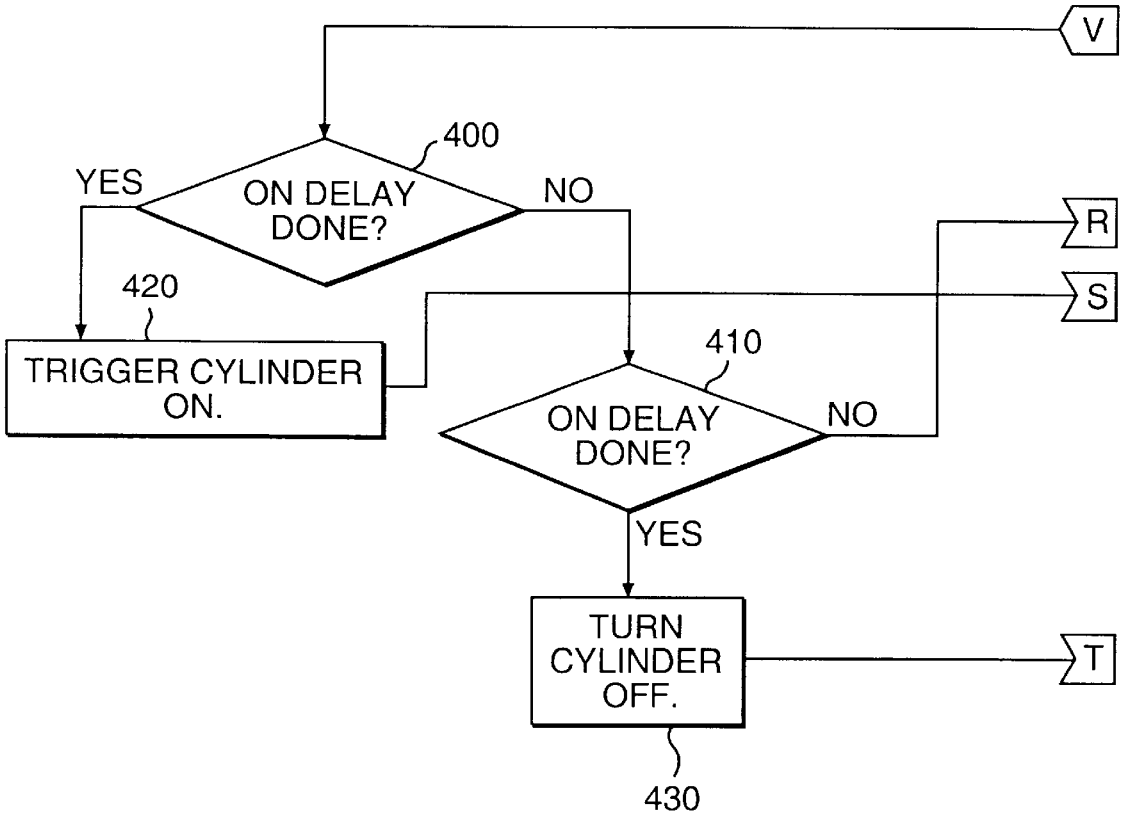
Figure 11F:
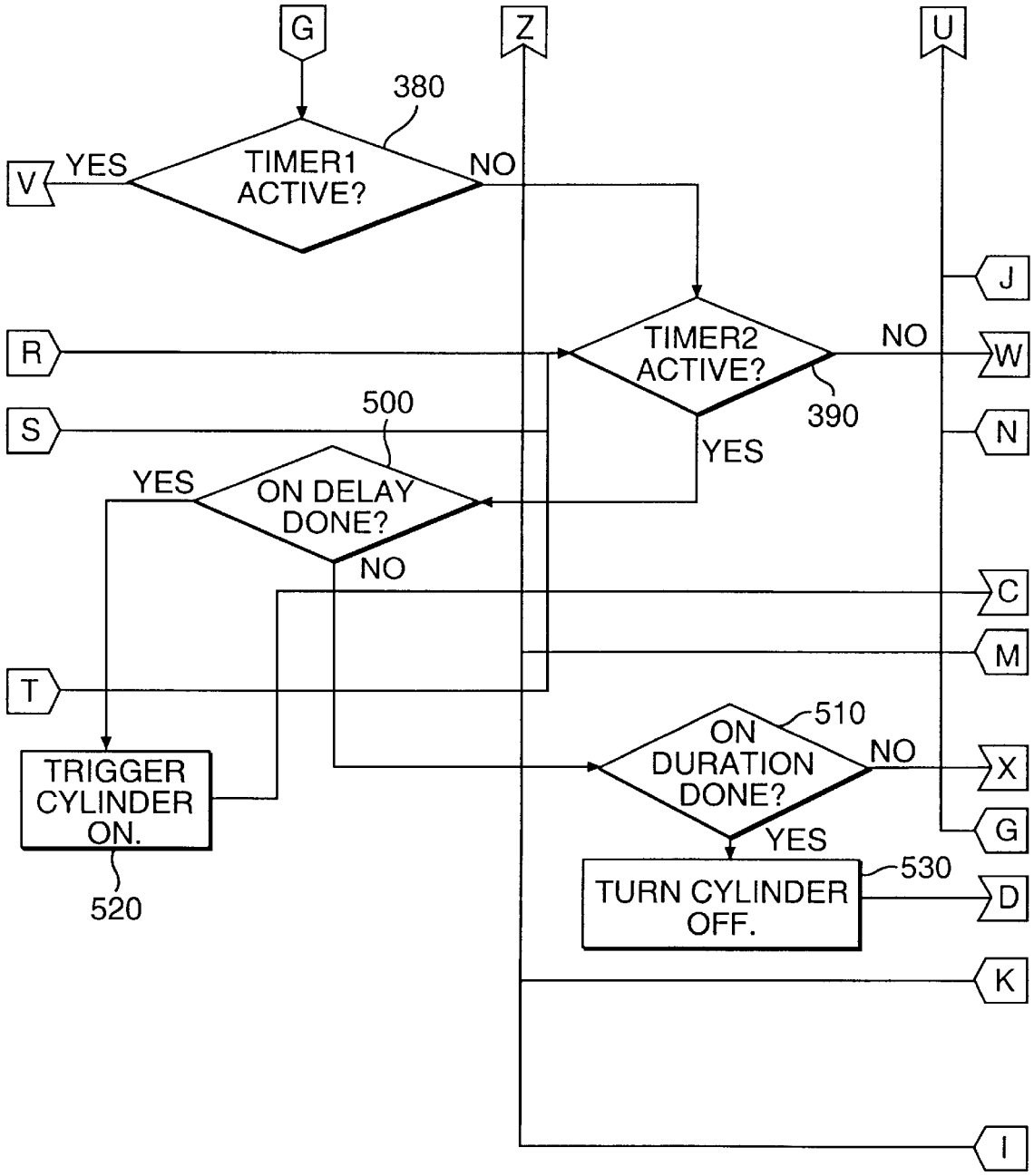
Figure 11G:
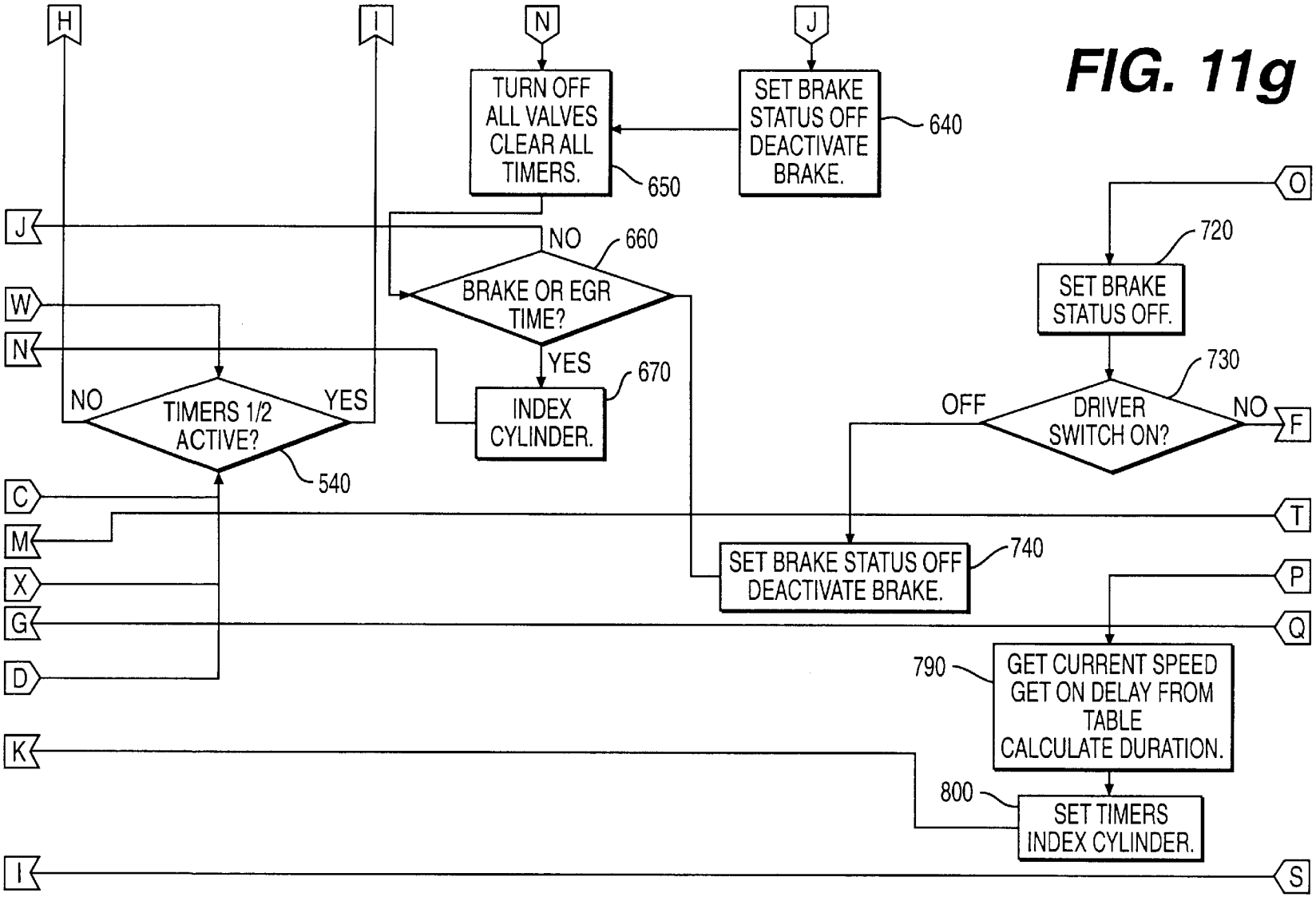
Figure 11H:
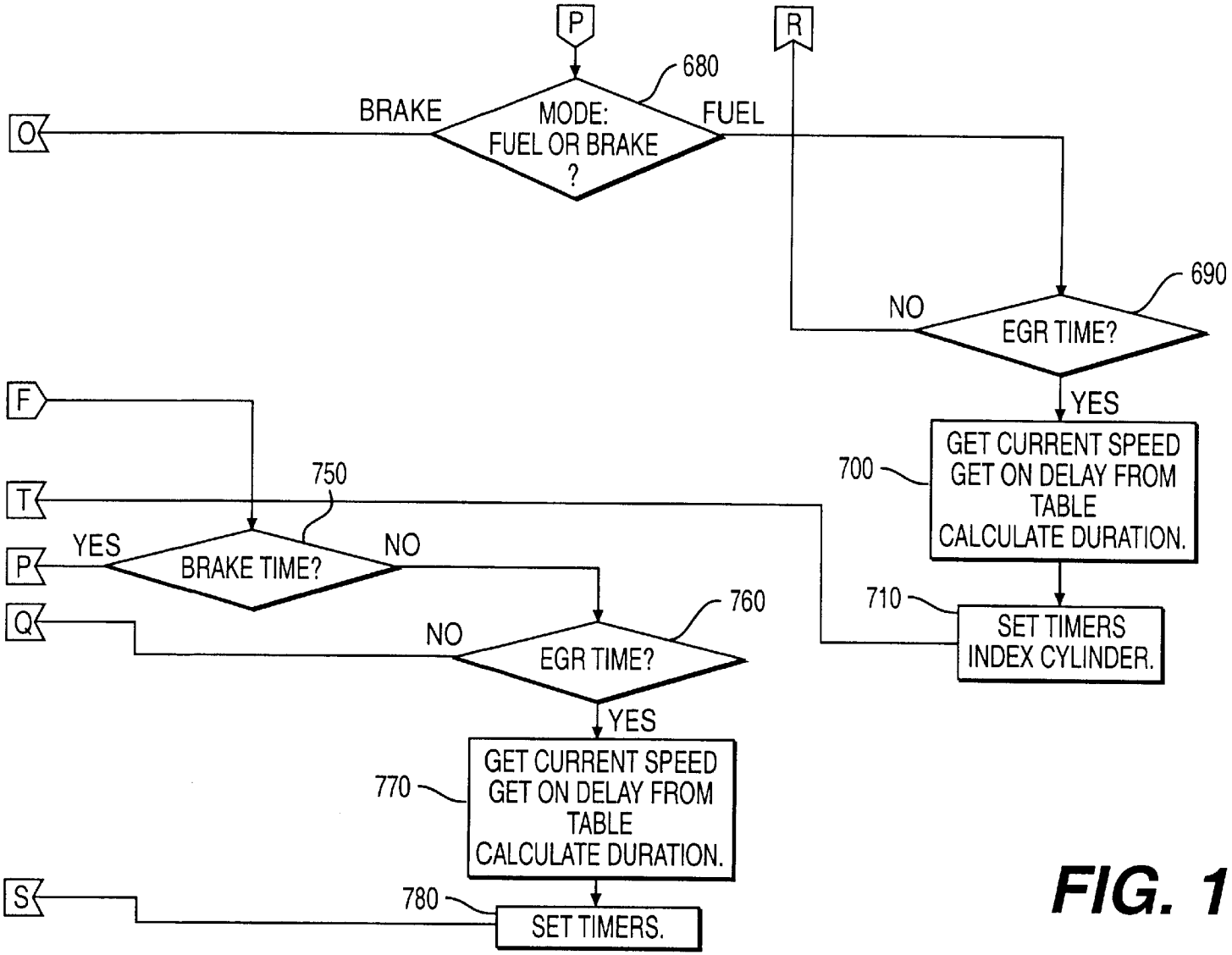

FIG. 9 shows a routine for (i) determining a Synchronous Reference Signal (SRS) which indicates the position of the engine crankshaft, and (ii) comparing the SRS with the TRS to synchronize the passing of teeth on the timing gear (interrupts) with particular engine positions. For example, at the time of the occurrence of an SRS, it may be expected that tooth (n) is passing past the fixed point. If comparison of the SRS and TRS indicates that tooth (n+3) rather than tooth (n) is passing past the fixed point, then an error may be indicated and the routine of FIG. 8 and 9 may be repeated.

Another alternative routine useful in carrying out the invention is illustrated by the operating sequence shown in FIGS. 10*a*–10*k*, inclusive (collectively FIG. 10). The TRS signals identified in FIG. 10 correspond to the engine location signals discussed above in conjunction with the routine of FIG. 11, and the SRS signals correspond to the synchronizing signals of FIG. 11.

It will be understood that the foregoing is only illustrative of the principles of this invention, and that various modifications can be made by those skilled in the art without departing from the scope and spirit of the invention. For example, not all of the engine and vehicle operation sensors and sensor reading steps may be needed in all cases, and those that are not needed can be readily eliminated from the apparatus (FIG. 2) and the processor operating sequence (FIG. 3). As another example of modifications within the scope of this invention, it may be possible (as in the above-referenced Hu U.S. Pat. No. 5,537,976) to convert the engine from four-cycle power mode operation to two-cycle operation during engine braking. In that event, processor 100 may operate to produce a compression release event each time an engine cylinder is approaching top dead center. Although processor 100 will then be producing compression release events twice as rapidly, as is generally assumed in the foregoing discussion, the basic operating principles of the invention are the same as described above.

Furthermore, it is understood that the routines of FIGS. 7–11, inclusive, may be implemented by various software modules other than those shown in the referenced figures. Variations of the illustrative routines, which achieve the functional results of the illustrative routines are intended to come within the scope of the invention, as described and claimed. For example, variations on the described method of synchronizing a brake control module with the engine, which do not use a crankshaft sensor for generating a synchronization signal, may still fall within the scope of the invention. Further, variations on the particular steps used to store, retrieve and apply trigger valve actuation timing signals should also be considered to fall within the scope of the present invention. Still further yet, the routines of FIGS. 7–11, inclusive, may be used to control valve actuation, not only for compression release braking and exhaust gas recirculation, but also for positive power intake and exhaust valve actuation.

We claim:

1. A method of controlling a means for selectively actuating a valve, said valve providing communication between an internal combustion engine exhaust manifold and a cylinder, so that a desired predetermined compression release valve event may be achieved, the method comprising the steps of:

sensing, during engine braking, one or more engine parameters selected from the group consisting of: a cylinder temperature, an exhaust manifold pressure, and the pressure of a hydraulic source in communication with said means for selectively actuating the valve;

determining, for an engine exhibiting the one or more of said sensed engine parameters, one or more desired valve event parameters selected from the group consisting of: a valve opening time, a valve closing time, and a valve lift; and actuating said valve in accordance with said one or more valve event parameters.

2. The method of claim 1 further comprising the step of sensing one or more engine parameters selected from the group consisting of:

engine speed, vehicle speed, clutch position, turbo charger boost pressure, fuel pump actuation, camshaft position, gas pressure in a cylinder of said engine, gas pressure in an intake manifold of said engine, ambient air temperature, and ambient barometric pressure.

3. A method of controlling a means for selectively actuating a valve, said valve providing communication between an internal combustion engine exhaust manifold and a cylinder, so that a desired predetermined valve event may be achieved, the method comprising the steps of:

providing an internal combustion engine including a control module operatively connected to one or more engine parameter sensors and to the means for selectively actuating a valve;

applying a retarder request signal to the control module;

monitoring with the sensors, one or more parameters selected from the group consisting of: fuel supply status, clutch status, transmission status, and engine speed;

activating a retarder main control responsive to the level of the one or more monitored parameters and the retarder request signal;

determining one or more conditions selected from the group consisting of: camshaft position, crankshaft position, engine speed, engine cylinder pressure, turbo charger boost pressure, vehicle speed control setting, vehicle speed, ambient air temperature, and ambient barometric pressure, responsive to the activation of the retarder main control;

determining a retarding torque requirement responsive to the level of the one or more determined conditions;

determining the number of engine cylinders to be used for compression release retarding events responsive to the level of the determined retarding torque requirement;

determining the times at which an exhaust valve should be opened and closed in each of the engine cylinders to be used to achieve the desired valve event; and opening and closing an exhaust valve at the determined times.

4. The method of claim 3 wherein the step of determining the number of engine cylinders to be used further comprises the step of:

determining the thermal loading of one or more of the engine cylinders.

5. The method of claim 4 wherein the step of determining the number of engine cylinders to be used further comprises the step of:

regulating exhaust back pressure in the engine.

6. The method of claim 4 wherein the step of determining the number of engine cylinders to be used further comprises the step of controlling the opening and closing of exhaust valves for exhaust gas recirculation for one or more of the cylinders to be used.

7. The method of claim 3 wherein the step of determining the number of engine cylinders to be used further comprises the step of:

regulating exhaust back pressure in the engine.

8. The method of claim 7 wherein the step of determining the number of engine cylinders to be used further comprises the step of controlling the opening and closing of exhaust valves for exhaust gas recirculation for one or more of the cylinders to be used.

9. The method of claim 3 wherein the times which the exhaust valve should be opened and closed are determined as a function of instantaneous engine speed and instantaneous engine position.

10. The method of claim 9 wherein the instantaneous engine positions are determined as a function of camshaft position and crankshaft position.

11. A method of determining the opening and closing times of a trigger valve in an internal combustion engine to carry out a desired level of compression release braking, the method comprising the steps of:

determining engine operation status;

determining engine position;

synchronizing a trigger valve controller with engine position;

determining the advisability of compression release braking;

determining trigger valve opening and closing times, responsive to engine position, said times determined such that they provide a desired compression release braking event;

storing the trigger valve opening and closing times in a memory;

reading the trigger valve opening and closing times from the memory and generating trigger valve actuation signals related to the read trigger valve times; and applying the trigger valve actuation signals to the trigger valve to actuate the trigger valve;

wherein the steps of determining engine operation status, determining engine position, and synchronizing a trigger valve controller comprise the steps of:

detecting the periodic occurrence of plural first engine events and the occurrence times thereof, said first engine events also being used to indicate times for trigger valve actuation;

determining an assumed engine position given the existence of a predetermined relationship between the occurrence times of the first engine events and the position of the engine;

detecting the cyclical occurrence of a second engine event and the occurrence time thereof;

determining an actual engine position given the existence of a predetermined relationship between the occurrence time of the second engine event and the position of the engine; and synchronizing the trigger valve controller by comparing the assumed and actual engine positions for a match.

12. The method of claim 11 wherein the plural first engine events comprise the passage of timing gear teeth past a fixed point.

13. The method of claim 11 wherein the second engine event comprises a complete revolution of a crankshaft.

14. A method of determining the opening and closing times of a trigger valve in an internal combustion engine to carry out a desired level of compression release braking, the method comprising the steps of:

determining engine operation status;

determining engine position;

synchronizing a trigger valve controller with engine position;

determining the advisability of compression release braking; and determining trigger valve opening and closing times, responsive to engine position, said times determined such that they provide a desired compression release braking event;

wherein the step of determining the advisability of compression release braking comprises the steps of:

determining engine speed to be within a predetermined range of speeds;

detecting a compression release braking request signal; and determining the status of a compression release braking driver switch.

15. A method of determining the opening and closing times of a trigger valve in an internal combustion engine to carry out a desired level of compression release braking, the method comprising the steps of:

determining engine operation status;

determining engine position;

synchronizing a trigger valve controller with engine position;

determining the advisability of compression release braking;

determining trigger valve opening and closing times, responsive to engine position, said times determined such that they provide a desired compression release braking event;

storing the trigger valve opening and closing times in a memory;

reading the trigger valve opening and closing times from the memory and generating trigger valve actuation signals related to the read trigger valve times; and applying the trigger valve actuation signals to the trigger valve to actuate the trigger valve;

wherein the steps of determining and storing trigger valve opening and closing times comprises the steps of:

reading the trigger valve opening and closing times from a look-up table;

determining instantaneous engine speed;

modifying the opening and closing times responsive to the determined engine speed;

determining the availability of a memory storage location for the opening and closing times; and storing the opening and closing times in the memory storage location responsive to the availability thereof.

16. The method of claim 15 further comprising the step of determining the availability of a second memory location for the opening and closing times responsive to the availability of the memory storage location.

17. A method of determining the opening and closing times of a trigger valve in an internal combustion engine to carry out a desired level of compression release braking, the method comprising the steps of:

determining engine operation status;

determining engine position by detecting the cyclical occurrence of an engine event and the occurrence time thereof, and determining an actual engine position given the existence of a predetermined relationship between the occurrence time of the engine event and the position of the engine; and synchronizing a trigger valve controller with engine position by determining an assumed engine position given the existence of a predetermined relationship between the passage times of the timing gear teeth and the position of the engine, and by comparing the assumed and actual engine positions for a match;

determining the advisability of compression release braking by determining engine speed to be within a predetermined range of speeds, detecting a compression release braking request signal, and determining the status of a compression release braking driver switch; and determining trigger valve opening and closing times, responsive to engine position, said times determined such that they provide a desired compression release braking event by reading the trigger valve opening and closing times from a look-up table, determining engine speed, and modifying the opening and closing times responsive to the determined engine speed.

18. The method of claim 17 further comprising the steps of:

storing the trigger valve opening and closing times in a memory by determining the availability of a memory storage location for the opening and closing times, and storing the opening and closing times in the memory storage location responsive to the availability thereof;

reading the trigger valve opening and closing times from the memory and generating trigger valve actuation signals related to the read trigger valve times; and applying the trigger valve actuation signals to the trigger valve to actuate the trigger valve.

19. An apparatus for determining the opening and closing times of a trigger valve in an internal combustion engine to carry out a desired level of compression release braking, the apparatus comprising:

a first sensor for sensing the passage of teeth on a gear, said first sensor being operatively connected to an engine timing gear;

a second sensor for sensing the rotation of an engine component selected from the group consisting of: a crankshaft and a camshaft; and computing means for:

determining engine operation status operatively connected to the first sensor;

determining engine position operatively connected to the second sensor;

synchronizing a trigger valve controller with engine position;

determining the advisability of compression release braking; and determining trigger valve opening and closing times responsive to engine position, said times determined such that they provide a desired compression release braking event.

20. The apparatus of claim 19 wherein said computing means further comprises means for:

storing the trigger valve opening and closing times in a memory;

reading the trigger valve opening and closing times from the memory and generating trigger valve actuation signals related to the read trigger valve times; and applying the trigger valve actuation signals to the trigger valve to actuate the trigger valve.

21. The apparatus of claim 19 further comprising a sensor operatively connected to the computing means, said sensor being capable of sensing an engine parameter selected from the group consisting of:

cylinder temperature, exhaust manifold pressure, engine speed, vehicle speed, clutch position turbo charger boost pressure fuel pump actuation, camshaft position, gas pressure in a cylinder of said engine, gas pressure in an intake manifold of said engine, ambient air temperature, and ambient barometric pressure.

22. The method of controlling a compression release engine brake of the type having an electrically operated hydraulic valve for selectively applying high pressure hydraulic fluid to a hydraulic actuator which responds to the application of said high pressure hydraulic fluid by opening a valve in an internal combustion engine associated with said engine brake to produce a compression release event in said engine, said method comprising the steps of:

monitoring the internal motion of said engine to detect the progress of the engine cylinder served by said valve in said engine through the cycle of operation of said engine cylinder;

monitoring at least one other operating condition of said engine, wherein said one other operating condition is selected from the group consisting of: cylinder temperature, exhaust manifold pressure, vehicle speed, fuel pump actuation, gas pressure in a cylinder of said engine, ambient air temperature, and ambient barometric pressure; and applying an electrical signal to said hydraulic valve to open said hydraulic valve at a time based at least in part on said progress of said engine cylinder and said other operating condition of said engine.

* * * * *